US009311895B2

(12) United States Patent
Ohara et al.

(10) Patent No.: US 9,311,895 B2
(45) Date of Patent: Apr. 12, 2016

(54) DISPLAY DEVICE AND METHOD FOR DRIVING SAME

(71) Applicant: Sharp Kabushiki Kaisha, Osaka-shi, Osaka (JP)

(72) Inventors: Masanori Ohara, Osaka (JP); Noboru Noguchi, Osaka (JP); Noritaka Kishi, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 14/654,114

(22) PCT Filed: Dec. 27, 2013

(86) PCT No.: PCT/JP2013/085097

§ 371 (c)(1),
(2) Date: Jun. 19, 2015

(87) PCT Pub. No.: WO2014/125752

PCT Pub. Date: Aug. 21, 2014

(65) Prior Publication Data

US 2015/0317952 A1 Nov. 5, 2015

(30) Foreign Application Priority Data

Feb. 15, 2013 (JP) ..... 2013-027368

(51) Int. Cl.
*G09G 5/00* (2006.01)
*G09G 5/18* (2006.01)
(Continued)

(52) U.S. Cl.
CPC ..... *G09G 5/18* (2013.01); *G09G 3/3233* (2013.01); *G09G 3/3291* (2013.01); *G09G 5/10* (2013.01); *G09G 2300/0804* (2013.01); *G09G 2310/0235* (2013.01)

(58) Field of Classification Search
CPC ..... G09G 3/3233; G09G 3/3291; G09G 3/32; G09G 5/10; G09G 5/18; G09G 2300/0804; G09G 2310/0235
USPC ..... 345/76–82, 87–93, 204–215
See application file for complete search history.

(56) References Cited

U.S. PATENT DOCUMENTS 5,748,160 A 5/1998 Shieh et al.
8,305,303 B2 * 11/2012 Nam ..... 345/76
(Continued)

FOREIGN PATENT DOCUMENTS

JP H09-138659 A 5/1997
JP H11-237606 A 8/1999
(Continued)

OTHER PUBLICATIONS

International Search Report PCT/ISA/210 for International Application No. PCT/JP2013/085097 dated Mar. 24, 2014.
(Continued)

*Primary Examiner* — Vijay Shankar
(74) *Attorney, Agent, or Firm* — Harness, Dickey & Pierce, P.L.C.

(57) ABSTRACT

An embodiment of the present invention realizes a display device equipped with a self light-emitting type display element driven by a current, by using a pixel circuit having a configuration simpler than a conventional configuration. A pixel circuit includes a driving transistor (T1), an input transistor (T2), a capacitor (Cst), and three organic EL elements (OLED(R), OLED(G), and OLED(B)). Cathode terminals of the organic EL elements (OLED(R), OLED(G), and OLED (B)) are respectively connected to low-level power supply lines (ELVSS(R), ELVSS(G), and ELVSS(B)). In such a configuration, in each sub-frame, only a low-level power supply voltage (ELVSS) corresponding to the sub-frame is set to a relatively low level, and the other low-level power supply voltages (ELVSS) are set to relatively high levels.

7 Claims, 29 Drawing Sheets

(51) Int. Cl.
*G09G 3/32* (2006.01)
*G09G 5/10* (2006.01)

(56) References Cited

U.S. PATENT DOCUMENTS

| | | | | |
|---|---|---|---|---|
| 8,462,086 | B2 * | 6/2013 | Takasugi et al. | 345/78 |
| 9,047,815 | B2 * | 6/2015 | Kimura | 345/77 |
| 2005/0104817 | A1 | 5/2005 | Kwak | |
| 2005/0104818 | A1 | 5/2005 | Kwak et al. | |
| 2005/0104875 | A1 | 5/2005 | Kwak et al. | |
| 2005/0225545 | A1 | 10/2005 | Takatori et al. | |
| 2010/0328367 | A1 | 12/2010 | Kwak et al. | |

FOREIGN PATENT DOCUMENTS

| | | | |
|---|---|---|---|
| JP | 2005-148749 | A | 6/2005 |
| JP | 2005-148750 | A | 6/2005 |
| JP | 2005-148751 | A | 6/2005 |
| JP | 2009-042446 | A | 2/2009 |
| JP | 2010-002755 | A | 1/2010 |
| JP | 2010-061172 | A | 3/2010 |

OTHER PUBLICATIONS

Written Opinion of the International Searching Authority PCT/ISA/237 for International Application No. PCT/JP2013/085097 dated Mar. 24, 2014.

* cited by examiner

SECOND CONVENTIONAL EXAMPLE

FIRST EMBODIMENT OF PRESENT INVENTION

Fig.31

DEFINITION ENHANCEMENT ↓

| RESOLUTION | PANEL SIZE (inch) | DEFINITION (ppi) | PIXEL SIZE (ONE SIDE) (μm) | PIXEL AREA (μm²) | PIXEL AREA RATIO BASED ON HD (%) |
|---|---|---|---|---|---|
| HD | 5.0 | 293 | 86.5 | 7482 | 100 |
| FHD | 5.0 | 440 | 57.75 | 3335 | 45 |
| WQHD | 5.0 | 564 | 45 | 2025 | 27 |
| 2k4k | 5.0 | 883 | 28.75 | 826 | 11 |

DISPLAY DEVICE AND METHOD FOR DRIVING SAME

TECHNICAL FIELD

The present invention relates to a display device, and more particularly to a display device, such as an organic EL display device and the like, equipped with a self light-emitting type display element driven by a current, and a method for driving the same.

BACKGROUND ART

Conventionally, as display elements included in a display device, there have been an electro-optical element of which luminance is controlled by an applied voltage, and an electro-optical element of which luminance is controlled by a flowing current. As a representative example of the electro-optical element of which luminance is controlled by the applied voltage, there is a liquid-crystal display element. Meanwhile, as a representative example of the electro-optical element of which luminance is controlled by the flowing current, there is an organic EL (electro-luminescence) element. The organic EL element is also referred to as an OLED (Organic Light-Emitting Diode). The organic EL display device using the organic EL element which is a self light-emitting type electro-optical element can easily achieve thinning, low power consumption, high luminance, and the like, as compared with a liquid crystal display device which requires backlight, a color filter, and the like. Therefore, in recent years, development of the organic EL display device has been positively progressed.

As a driving system of the organic EL display device, there have been known a passive matrix system (also referred to as a simple matrix system) and an active matrix system. The organic EL display device employing the passive matrix system has a simple structure, but it is difficult to achieve size increase and definition enhancement. Meanwhile, the organic EL display device employing the active matrix system (hereinafter, referred to as an "active matrix-type organic EL display device") can easily realize size increase and definition enhancement as compared with the organic EL display device employing the passive matrix system.

The active matrix-type organic EL display device includes a plurality of pixel circuits arranged in a matrix. Each of the pixel circuits of the active matrix-type organic EL display device typically includes an input transistor for selecting a pixel, and a driving transistor for controlling a supply of a current to the organic EL element. Note that in the following, a current flowing from the driving transistor to the organic EL element is also referred to as a "driving current".

Ina general active matrix-type organic EL display device, one pixel includes three sub-pixels (an R sub-pixel which displays a red color, a G sub-pixel which displays a green color, and a B sub-pixel which displays a blue color). FIG. 26 is a circuit diagram illustrating a configuration of a conventional general pixel circuit 91 configuring one sub-pixel. The pixel circuit 91 is provided corresponding to each of intersections of a plurality of data lines DL and a plurality of scanning signal lines SL which are arranged in a display unit. As illustrated in FIG. 26, the pixel circuit 91 includes two transistors T1 and T2, one capacitor Cst, and one organic EL element OLED. The transistor T1 is a driving transistor, and the transistor T2 is an input transistor. It should be noted that, in the example illustrated in FIG. 26, the transistors T1 and T2 are n-channel thin film transistors (TFT).

The transistor T1 is provided in series with the organic EL element OLED. Concerning the transistor T1, a drain terminal is connected to a power supply line for supplying a high-level power supply voltage ELVDD (hereinafter, referred to as a "high-level power supply line", and designated with the same symbol ELVDD as that given to the high-level power supply voltage), and a source terminal is connected to an anode terminal of the organic EL element OLED. The transistor T2 is provided between a data line DL and a gate terminal of the transistor T1. Concerning the transistor T2, a gate terminal is connected to a scanning signal line SL, and a source terminal is connected to the data line DL. Concerning the capacitor Cst, one end is connected to the gate terminal of the transistor T1, and the other end is connected to the source terminal of the transistor T1. A cathode terminal of the organic EL element OLED is connected to a power supply line for supplying a low-level power supply voltage ELVSS (hereinafter, referred to as a "low-level power supply line", and designated with the same symbol ELVSS as that given to the low-level power supply voltage). Hereinafter, a connection point of the gate terminal of the transistor T1, one end of the capacitor Cst, and the drain terminal of the transistor T2 will be referred to as a "gate node VG" for convenience (this is similarly applied to FIG. 1 and FIG. 17). It should be noted that, in general, one of the drain and the source having a higher potential is called a drain. However, in the description of the present specification, one is defined as a drain, and the other is defined as a source. Therefore, a source potential becomes higher than a drain potential in some cases.

FIG. 27 is a timing chart for describing the operation of the pixel circuit 91 illustrated in FIG. 26. Before time t1, the scanning signal line SL is in an unselected state. Therefore, before the time t1, the transistor T2 is in an OFF state, and the potential of the gate node VG maintains an initial level (a level according to writing in one preceding frame, for example). At the time t1, the scanning signal line SL becomes in a selected state, and the transistor T2 is turned on. Accordingly, via the data line DL and the transistor T2, a data voltage Vdata corresponding to the luminance of a pixel (a sub-pixel) formed by the pixel circuit 91 is supplied to the gate node VG. Thereafter, during a period till time t2, the potential of the gate node VG changes according to the data voltage Vdata. At this time, the capacitor Cst is charged to a gate-source voltage Vgs which is a difference between the potential of the gate node VG and the source potential of the transistor T1. At the time t2, the scanning signal line SL becomes in an unselected state. Accordingly, the transistor T2 is turned off, and the gate-source voltage Vgs held by the capacitor Cst is established. The transistor T1 supplies a driving current to the organic EL element OLED according to the gate-source voltage Vgs held by the capacitor Cst. As a result, the organic EL element OLED emits light with the luminance corresponding to the driving current.

Incidentally, the pixel circuit 91 illustrated in FIG. 26 is a circuit corresponding to one sub-pixel. Therefore, a pixel circuit 910 corresponding to one pixel including three sub-pixels has a configuration as illustrated in FIG. 28. As illustrated in FIG. 28, the pixel circuit 910 configuring one pixel includes a pixel circuit 91(R) for an R sub-pixel, a pixel circuit 91(G) for a G sub-pixel, and a pixel circuit 91(B) for a B sub-pixel. Note that in the following, the configuration illustrated in FIG. 28 will be referred to as a "first conventional example". As can be understood from FIG. 28, according to the first conventional example, six transistors and three capacitors are necessary per one pixel.

In the case of a configuration requiring many circuit elements in the pixel circuit, it is difficult to achieve definition enhancement. Therefore, Japanese Patent Application Laid-Open No. 2005-148749 discloses a pixel circuit 920 having a configuration in which numbers of transistors and capacitors necessary per one pixel are smaller than numbers necessary in the first conventional example, as illustrated in FIG. 29. Note that in the following, the configuration illustrated in FIG. 29 will be referred to as a "second conventional example". The pixel circuit 920 in the second conventional example includes a driving means 921, a sequential control means 922, and three organic EL elements OLED(R), OLED(G), and OLED (B). The driving means 921 includes a driving transistor T11, an input transistor T12, and a capacitor Cst1. The sequential control means 922 includes a transistor T13(R) for controlling light emission of the red-color organic EL element OLED(R), a transistor T13(G) for controlling light emission of the green-color organic EL element OLED(G), and a transistor T13(B) for controlling light emission of the blue-color organic EL element OLED(B).

In the above configuration, one frame period is divided into an R sub-frame for emitting red color light, a G sub-frame for emitting green color light, and a B sub-frame for emitting blue color light. Then, in the sequential control means 922, only the transistor T13(R) is set to an ON state in the R sub-frame, only the transistor T13(G) is set to an ON state in the G sub-frame, and only the transistor T13(B) is set to an ON state in the B sub-frame. Thus, over the one frame period, the organic EL element OLED(R), the organic EL element OLED(G), and the organic EL element OLED(B) are caused to sequentially emit light so that a desired color image is displayed. It should be noted that ON/OFF of the transistors T13(R), T13(G), and T13(B) is controlled by light-emission control signals given respectively to light-emission control lines 923(R), 923(G), and 923(B). According to the second conventional example, five transistors and one capacitor are necessary per one pixel.

Japanese Patent Application Laid-Open No. 2005-148750 discloses a pixel circuit 930 having a configuration in which numbers of data lines and capacitors are smaller than numbers necessary in the first conventional example, as illustrated in FIG. 30. Note that in the following, the configuration illustrated in FIG. 30 will be referred to as a "third conventional example". As can be understood from FIG. 30, according to the third conventional example, although the number of transistors becomes larger than that necessary in the first conventional example, the numbers of data lines and capacitors become smaller than those necessary in the first conventional example.

PRIOR ART DOCUMENTS

Patent Documents

[Patent Document 1] Japanese Patent Application Laid-Open No. 2005-148749

[Patent Document 2] Japanese Patent Application Laid-Open No. 2005-148750

SUMMARY OF THE INVENTION

Problems to be Solved by the Invention

Incidentally, in the field of the display device, while development for definition enhancement has been conventionally progressed, development for further definition enhancement (ultra definition enhancement) has been progressed in recent years. For example, display devices capable of displaying in the resolution of "2160×4096" called "2k4k" are also being commercially manufactured. FIG. 31 is a diagram for describing reduction in the layout area per one pixel accompanying definition enhancement. For example, in the case of realizing a display device of WQHD (Wide Quad High Definition) by using a 5.0-inch panel, definition becomes 564 ppi, a length of one side of a pixel becomes 45 micrometers, an area of one pixel becomes 2025 square micrometers, and a pixel area ratio based on a display device of HD (High Definition) by using a panel of the same size becomes 27 percent. According to FIG. 31, when the definition of the display device with a 5.0-inch panel is enhanced from HD to FHD (Full High Definition), the area of one pixel becomes 45 percent of the area before the definition enhancement. Further, when the definition of the display device with a 5.0-inch panel is enhanced from HD to 2k4k, the area of one pixel becomes 11 percent of the area before the definition enhancement. In this way, as definition enhancement is progressed, the area of one pixel becomes smaller. Therefore, as definition enhancement is progressed, the number of circuit elements that can be arranged in the area of one pixel becomes smaller.

However, concerning the organic EL display device, a relatively large number of transistors are necessary in the pixel circuit as described above. According to the third conventional example, although the numbers of data lines and capacitors become smaller than those necessary in the first conventional example, eight transistors are necessary per one pixel. According to the second conventional example, the number of transistors necessary per one pixel is five. However, in an ultra high-definition panel whose definition exceeds 500 ppi, it is difficult to dispose five transistors in the area of one pixel.

Therefore, an object of the present invention is to realize a display device equipped with a self light-emitting type display element driven by a current, by using a pixel circuit having a configuration simpler than a conventional configuration.

Means for Solving the Problems

A first aspect of the present invention is directed to an active matrix-type display device configured to display a color image by dividing one frame period into a plurality of sub-frames and displaying a screen image of a different color for each of the sub-frames, the active matrix-type display device comprising:

a plurality of data lines;

a plurality of scanning signal lines disposed to be orthogonal to the plurality of data lines;

a plurality of pixel circuits provided corresponding to intersections of the plurality of data lines and the plurality of scanning signal lines;

a first power supply line configured to supply a constant voltage to the plurality of pixel circuits;

a plurality of second power supply lines configured to supply a relatively high-level first voltage and a relatively low-level second voltage to the plurality of pixel circuits, the plurality of second power supply lines corresponding, in a one-to-one manner, to the plurality of sub-frames included in the one frame period;

a data line drive circuit configured to apply a video signal to the plurality of data lines;

a scanning signal line drive circuit configured to apply a scanning signal to the plurality of scanning signal lines; and a second power supply control unit configured to control a voltage to be given to the plurality of second power supply lines, wherein the pixel circuit comprises:

a plurality of self light-emitting type electro-optical elements provided between each of the plurality of second power supply lines and the first power supply line, the plurality of self light-emitting type electro-optical elements corresponding, in a one-to-one manner, to the plurality of sub-frames included in the one frame period;

one first transistor that is provided to be in series with the plurality of electro-optical elements between the first power supply line and the plurality of second power supply lines, and that controls a driving current to be supplied to the plurality of electro-optical elements;

a second transistor that is provided between a control terminal of the first transistor and one of the data lines, and that electrically connects the control terminal of the first transistor and the data line when a scanning signal applied to a corresponding scanning signal line has been set active by the scanning signal line drive circuit; and a capacitor provided between the control terminal of the first transistor and one conductive terminal of the first transistor, and when any sub-frame included in the one frame period is assumed as a focused sub-frame, the second power supply control unit controls a voltage to be given to the plurality of second power supply lines such that, in the focused sub-frame, a voltage applied to an electro-optical element corresponding to the focused sub-frame becomes equal to or higher than a light emission threshold value and also a voltage applied to an electro-optical element other than the electro-optical element corresponding to the focused sub-frame becomes less than the light emission threshold value.

According to a second aspect of the present invention, in the first aspect of the present invention, the data line drive circuit applies a voltage corresponding to a black color as the video signal to the plurality of data lines during a flyback period of each of the sub-frames, and the scanning signal line drive circuit applies active scanning signals simultaneously to the plurality of scanning signal lines during a flyback period of each of the sub-frames.

According to a third aspect of the present invention, in the first aspect of the present invention, a sub-frame appears 180 times or more during one second.

According to a fourth aspect of the present invention, in the first aspect of the present invention, a constant voltage given to the first power supply line is set to a higher level than that of the first voltage, and the second power supply control unit controls a voltage to be given to the plurality of second power supply lines such that, in the focused sub-frame, the second voltage is given to a second power supply line corresponding to the focused sub-frame and also the first voltage is given to a second power supply line other than the second power supply line corresponding to the focused sub-frame.

According to a fifth aspect of the present invention, in the first aspect of the present invention, the first transistor and the second transistor are thin-film transistors having a channel layer formed of an oxide semiconductor.

According to a sixth aspect of the present invention, in the fifth aspect of the present invention, the oxide semiconductor is Indium Gallium Zinc Oxide including indium (In), gallium (Ga), zinc (Zn), and oxygen (O) as main components.

A seventh aspect of the present invention is directed to a method for driving an active matrix-type display device configured to display a color image by dividing one frame period into a plurality of sub-frames and displaying a screen image of a different color for each of the sub-frames, the active matrix-type display device comprising a plurality of data lines; a plurality of scanning signal lines disposed to be orthogonal to the plurality of data lines; a plurality of pixel circuits provided corresponding to intersections of the plurality of data lines and the plurality of scanning signal lines; a first power supply line configured to supply a constant voltage to the plurality of pixel circuits; and a plurality of second power supply lines configured to supply a relatively high-level first voltage and a relatively low-level second voltage to the plurality of pixel circuits, the plurality of second power supply lines corresponding, in a one-to-one manner, to the plurality of sub-frames included in the one frame period; the method comprising:

a data line driving step for applying a video signal to the plurality of data lines;

a scanning signal line driving step for applying a scanning signal to the plurality of scanning signal lines; and a second power supply control step for controlling a voltage to be given to the plurality of second power supply lines, wherein the pixel circuit comprises:

a plurality of self light-emitting type electro-optical elements provided between each of the plurality of second power supply lines and the first power supply the plurality of self light-emitting type electro-optical elements corresponding, in a one-to-one manner, to the plurality of sub-frames included in the one frame period, one first transistor that is provided to be in series with the plurality of electro-optical elements between the first power supply line and the plurality of second power supply lines, and that controls a driving current to be supplied to the plurality of electro-optical elements, a second transistor that is provided between a control terminal of the first transistor and one of the data lines, and that electrically connects the control terminal of the first transistor and the data line when a scanning signal applied to a corresponding scanning signal line has been set active in the scanning signal line driving step, and a capacitor provided between the control terminal of the first transistor and one conductive terminal of the first transistor, and when any sub-frame included in the one frame period is assumed as a focused sub-frame, in the second power supply control step, a voltage to be given to the plurality of second power supply lines is controlled such that, in the focused sub-frame, a voltage applied to an electro-optical element corresponding to the focused sub-frame becomes equal to or higher than a light emission threshold value and also a voltage applied to an electro-optical element other than the electro-optical element corresponding to the focused sub-frame becomes less than the light emission threshold value.

Effects of the Invention

According to the first aspect of the present invention, in a display device equipped with a self light-emitting type electro-optical element, the number of transistors necessary per one pixel becomes two without losing desired color display. On the other hand, in a display device equipped with a pixel circuit having the conventional simplest configuration, five transistors have been necessary per one pixel. Thus, according to the first aspect of the present invention, the number of transistors necessary per one pixel is reduced as compared with the conventional example. That is, a display device equipped with a self light-emitting type electro-optical element can be realized by using a pixel circuit having a configuration simpler than the conventional configuration. Accordingly, ultra definition enhancement of the display device becomes possible.

According to the second aspect of the present invention, data corresponding to black display is written during a fly-back period of each sub-frame. Therefore, light emission of the electro-optical element with the luminance corresponding to the writing in one preceding sub-frame can be prevented in each sub-frame. As a result, more satisfactory display quality can be realized.

According to the third aspect of the present invention, because high speed driving is performed, even when the electro-optical element emits light with the luminance corresponding to the writing in one preceding sub-frame, the electro-optical element immediately emits light in the original luminance. Therefore, even when the electro-optical element momentarily emits light with the luminance different from the original luminance, a desired color image is visually recognized by the human eyes.

According to the fourth aspect of the present invention, effects similar to those in the first aspect of the present invention can be obtained without making the operation complex due to the provision of a plurality of second power supply lines.

According to the fifth aspect of the present invention, as the transistor provided in the pixel circuit, a thin-film transistor having a channel layer formed of an oxide semiconductor is used. Therefore, miniaturization of the transistor in the pixel circuit has become possible, and it becomes easier to achieve ultra definition enhancement of the display device.

According to the sixth aspect of the present invention, by using Indium Gallium Zinc Oxide as the oxide semiconductor that forms the channel layer, effects of the fifth aspect of the present invention can be securely achieved.

According to the seventh aspect of the present invention, effects similar to those in the first aspect of the present invention can be obtained in the method for driving a display device.

BRIEF DESCRIPTION OF THE DRAWINGS

FIG. 31 is a diagram for describing reduction in the layout area per one pixel accompanying definition enhancement.

MODES FOR CARRYING OUT THE INVENTION

Embodiments of the present invention will be described below with reference to the appended drawings.

<1. First Embodiment>

<1.1 Overall Configuration>

Figure 2:
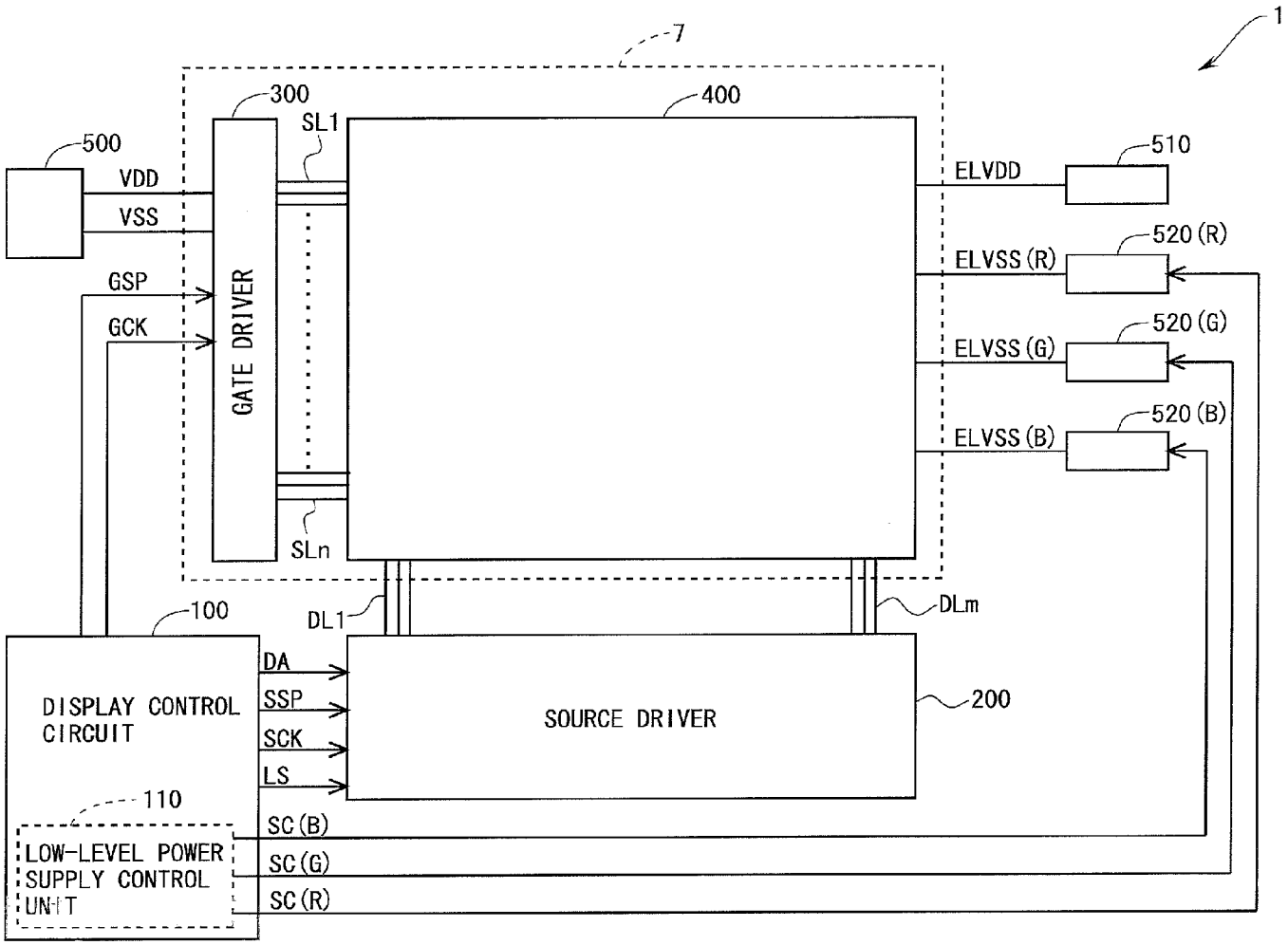
FIG. 2 is a block diagram illustrating an overall configuration of the active matrix-type organic EL display device in the first embodiment.

FIG. 2 is a block diagram illustrating an overall configuration of an active matrix-type organic EL display device 1 according to a first embodiment of the present invention. The organic EL display device 1 includes a display control circuit 100, a source driver (a data line drive circuit) 200, a gate driver (a scanning signal line drive circuit) 300, and a display unit 400. Note that in the present embodiment, the gate driver 300 is formed in an organic EL panel 7 including the display unit 400. That is, the gate driver 300 is made monolithic. Further, the organic EL display device 1 is provided with, as components for supplying various power supply voltages to the organic EL panel 7, a logic power supply 500, an organic EL high-level power supply 510, a red-color organic EL low-level power supply 520(R), a green-color organic EL low-level power supply 520(G), and a blue-color organic EL low-level power supply 520(B). Further, the display control circuit 100 is provided with a low-level power supply control unit 110 for controlling operations of the red-color organic EL low-level power supply 520(R), the green-color organic EL low-level power supply 520(G), and the blue-color organic EL low-level power supply 520(B). Note that in the present embodiment, a second power supply control unit is realized by the low-level power supply control unit 110.

The logic power supply 500 supplies, to the organic EL panel 7, a high-level power supply voltage VDD and a low-level power supply voltage VSS that are necessary for the operation of the gate driver 300. The organic EL high-level power supply 510 supplies, to the organic EL panel 7, a high-level power supply voltage ELVDD as a constant voltage. The red-color organic EL low-level power supply 520(R) supplies, to the organic EL panel 7, a red-color organic EL low-level power supply voltage ELVSS(R). Note that, a power supply line for supplying the red-color organic EL low-level power supply voltage ELVSS(R) will be hereinafter referred to as a "red-color organic EL low-level power supply line". The red-color organic EL low-level power supply line will be designated with the same symbol ELVSS(R) as that given to the red-color organic EL low-level power supply voltage. The green-color organic EL low-level power supply 520(G) supplies, to the organic EL panel 7, a green-color organic EL low-level power supply voltage ELVSS(G). Note that, a power supply line for supplying the green-color organic EL low-level power supply voltage ELVSS(G) will be hereinafter referred to as a "green-color organic EL low-level power supply line". The green-color organic EL low-level power supply line will be designated with the same symbol ELVSS(G) as that given to the green-color organic EL low-level power supply voltage. The blue-color organic EL low-level power supply 520(B) supplies, to the organic EL panel 7, a blue-color organic EL low-level power supply voltage ELVSS(B). Note that, a power supply line for supplying the blue-color organic EL low-level power supply voltage ELVSS(B) will be hereinafter referred to as a "blue-color organic EL low-level power supply line". The blue-color organic EL low-level power supply line will be designated with the same symbol ELVSS(B) as that given to the blue-color organic EL low-level power supply voltage. In the following, the red-color organic EL low-level power supply line ELVSS(R), the green-color organic EL low-level power supply line ELVSS(G), and the blue-color organic EL low-level power supply line ELVSS(B) will also be collectively simply referred to as a "low-level power supply line ELVSS".

Figure 3:
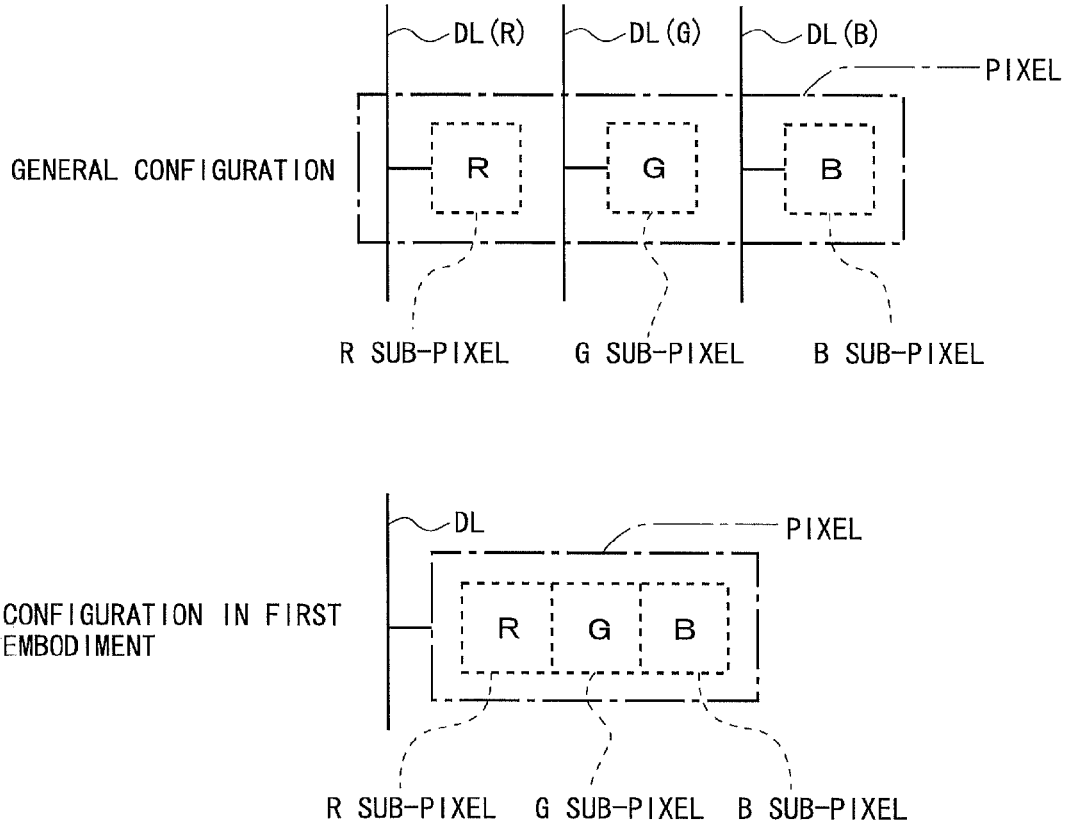
FIG. 3 is a diagram for describing a relationship between a pixel and a data line in the first embodiment.

In the display unit 400, a plurality of (m) data lines DL1 to DLm and a plurality of (n) scanning signal lines SL1 to SLn are arranged so as to cross each other. A pixel circuit corresponding to one pixel is formed to correspond to each of intersections of the data lines DL1 to DLm and the scanning signal lines SL1 to SLn. In the general configuration, a data line is provided for each of colors of sub-pixels. For example, when one pixel includes three sub-pixels (an R sub-pixel, a G sub-pixel, and a B sub-pixel), there are provided a data line DL(R) corresponding to the R sub-pixel, a data line DL(G) corresponding to the G sub-pixel, and a data line DL(B) corresponding to the B sub-pixel (see FIG. 3). On the other hand, in the present embodiment, there is provided a data line DL which is common to the R sub-pixel, the G sub-pixel, and the B sub-pixel (see FIG. 3). Therefore, the number of data lines in the present embodiment is one third of the number of data lines in the general configuration. It should be noted that a detailed configuration of the pixel circuit will be described later.

The display control circuit 100 outputs: display data DA; a source start pulse signal SSP, a source clock signal SCK, and a latch strobe signal LS which are for controlling the operation of a source driver 200; and a gate start pulse signal GSP and a gate clock signal GCK which are for controlling the operation of the gate driver 300. The low-level power supply control unit 110 in the display control circuit 100 outputs a control signal SC(R) for controlling the operation of the red-color organic EL low-level power supply 520(R), a control signal SC(G) for controlling the operation of the green-color organic EL low-level power supply 520(G), and a control signal SC(B) for controlling the operation of the blue-color organic EL low-level power supply 520(B). It should be noted that the low-level power supply control unit 110 is not necessarily provided in the display control circuit 100.

Figure 4:
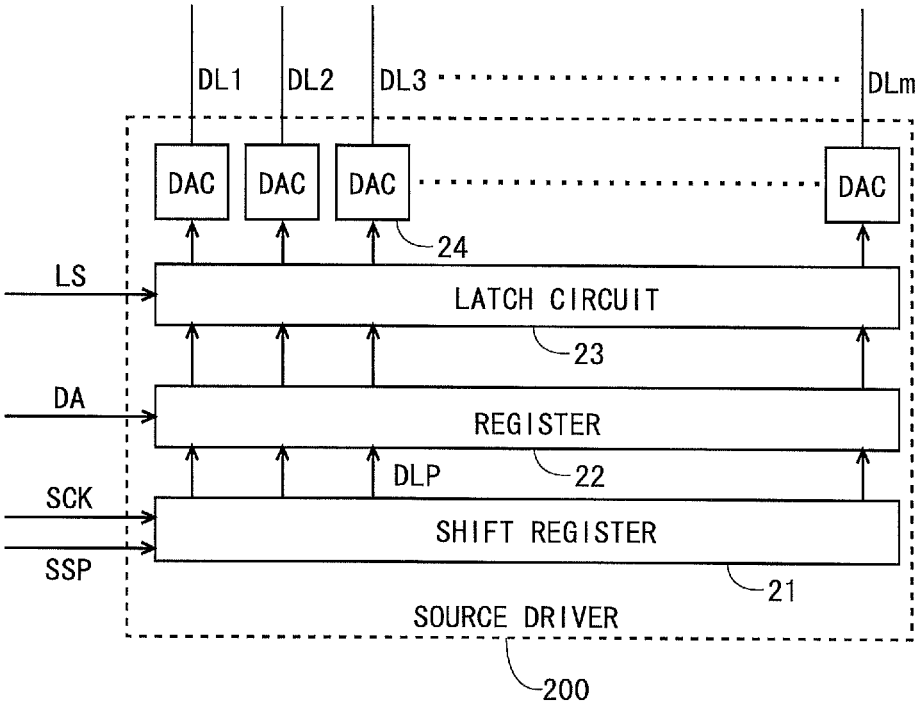
FIG. 4 is a block diagram illustrating a configuration of a source driver in the first embodiment.

The source driver 200 receives the display data DA, the source start pulse signal SSP, the source clock signal SCK, and the latch strobe signal LS which are transmitted from the display control circuit 100, and applies driving video signals to the data lines DL1 to DLm. FIG. 4 is a block diagram illustrating a configuration of the source driver 200. The source driver 200 includes an m-bit shift register 21, a register 22, a latch circuit 23, and m D/A converters (DAC) 24. The shift register 21 has m registers (not illustrated) connected in cascade. The shift register 21 sequentially transfers, from an input terminal to an output terminal, a pulse of the source start pulse signal SSP supplied to a first-stage register, based on the source clock signal SCK. In accordance with this transfer of the pulse, a timing pulse DLP corresponding to each data line DL is output from the shift register 21. Based on the timing pulse DLP, the register 22 stores the display data DA. The latch circuit 23 takes in and holds the display data DA corresponding to one row stored in the register 22, according to the latch strobe signal LS. A D/A converter 24 is provided to correspond to each data line DL. The D/A converter 24 converts the display data DA held in the latch circuit 23 into an analog voltage. The converted analog voltages are simultaneously applied to all the data lines DL1 to DLm as driving video signals.

Figure 5:
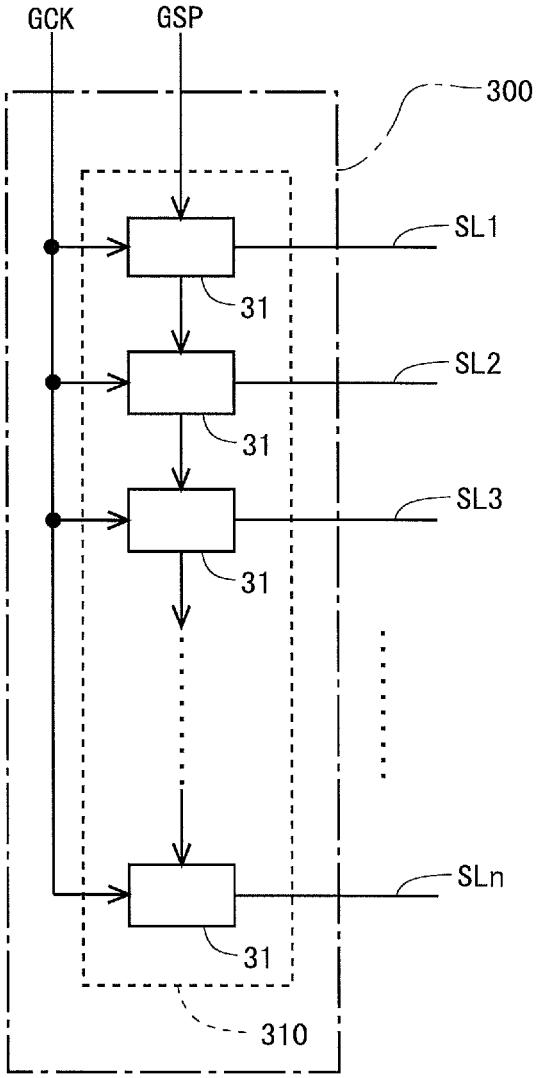
FIG. 5 is a block diagram illustrating a configuration of a gate driver in the first embodiment.

The gate driver 300 sequentially applies active scanning signals to the n scanning signal lines SL1 to SLn, based on the gate start pulse signal GSP and the gate clock signal GCK which are transmitted from the display control circuit 100. FIG. 5 is a block diagram illustrating a configuration of the gate driver 300. The gate driver 300 is constituted by a shift register 310 including n flip-flop circuits 31. The shift register 310 is configured such that the gate start pulse signal GSP is given to a first stage flip-flop circuit 31, and the gate clock signal GCK is given in common to all the flip-flop circuits 31. In this configuration, immediately after starting each subframe, a pulse of the gate start pulse signal GSP is given to the first stage flip-flop circuit 31 of the shift register 310. Consequently, based on the gate clock signal GCK, the pulse included in the gate start pulse signal GSP is sequentially transferred from the first stage flip-flop circuit 31 to the n-th stage flip-flop circuit 31. Then, based on this transfer of the pulse, output signals from the first stage to n-th stage flip-flop circuits 31 sequentially become at high levels. As a result, active scanning signals are sequentially applied to the n scanning signal lines SL1 to SLn.

In the manner as described above, driving video signals are applied to the m data lines DL1 to DLm, and scanning signals are applied to the n scanning signal lines SL1 to SLn so that a desired color image is displayed in the display unit 400.

<1.2 Configuration of Pixel Circuit>

Figure 1:
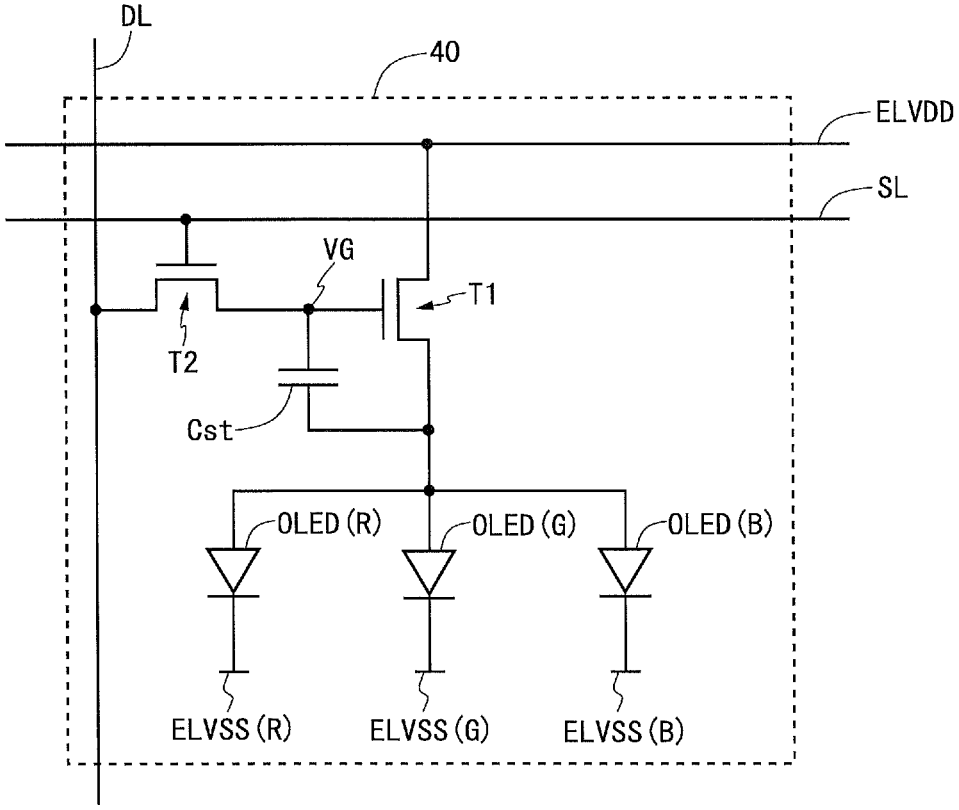
FIG. 1 is a circuit diagram illustrating a configuration of a pixel circuit corresponding to one pixel in an active matrix-type organic EL display device according to a first embodiment of the present invention.

FIG. 1 is a circuit diagram illustrating a configuration of a pixel circuit 40 corresponding to one pixel in the present embodiment. The pixel circuit 40 is provided corresponding to each of intersections of the m data lines DL1 to DLm and the n scanning signal lines SL1 to SLn which are arranged in the display unit 400. As illustrated in FIG. 1, the pixel circuit 40 includes two transistors T1 and T2, one capacitor Cst, and three organic EL elements OLED(R), OLED(G), and OLED (B). The transistor T1 is a driving transistor, and the transistor T2 is an input transistor. The organic EL element OLED(R) functions as an electro-optical element that emits red color light. The organic EL element OLED(G) functions as an electro-optical element that emits green color light. The organic EL element OLED(B) functions as an electro-optical element that emits blue color light. Note that in the following, the three organic EL elements OLED(R), OLED(G), and OLED(B) will also be collectively simply referred to as an "organic EL element OLED". In the present embodiment, a first transistor is realized by the transistor T1, and a second transistor is realized by the transistor T2.

As illustrated in FIG. 1, the transistor T1 is provided in series with the organic EL elements OLED(R), OLED(G), and OLED(B). Concerning the transistor T1, a drain terminal is connected to the high-level power supply line ELVDD, and a source terminal is connected to anode terminals of the organic EL elements OLED(R), OLED(G), and OLED(B). The transistor T2 is provided between a data line DL and a gate terminal of the transistor T1. Concerning the transistor T2, a gate terminal is connected to a scanning signal line SL, and a source terminal is connected to the data line DL. Concerning the capacitor Cst, one end is connected to the gate terminal of the transistor T1, and the other end is connected to the source terminal of the transistor T1. A cathode terminal of the organic EL element OLED(R) is connected to the red-color organic EL low-level power supply line ELVSS(R). A cathode terminal of the organic EL element OLED(G) is connected to the green-color organic EL low-level power supply line ELVSS(G). A cathode terminal of the organic EL element OLED(B) is connected to the blue-color organic EL low-level power supply line ELVSS(B).

Incidentally, in the present embodiment, the transistors T1 and T2 are n-channel TFTs (thin-film transistors). Moreover, in the present embodiment, an oxide TFT (a thin-film transistor using an oxide semiconductor for the channel layer) is employed as the transistors T1 and T2. Specifically, there is employed an IGZO-TFT having a channel layer formed by InGaZnOx (Indium Gallium Zinc Oxide) (hereinafter, referred to as "IGZO"which is an oxide semiconductor including indium (In), gallium (Ga), zinc (Zn), and oxygen (O) as main components. It should be noted that an oxide TFT such as the IGZO-TFT is effective particularly when employed as an n-channel transistor included in the pixel circuit 40. However, the present invention does not exclude the use of a p-channel oxide TFT. Moreover, a transistor using an oxide semiconductor other than IGZO for the channel layer can also be employed. For example, when a transistor is employed using, for the channel layer, an oxide semiconductor including at least one of indium, gallium, zinc, copper (Cu), silicon (Si), tin (Sn), aluminum (Al), calcium (Ca), germanium (Ge), and lead (Pb), similar effects can also be obtained. Further, the present invention does not exclude the use of a transistor other than a transistor using an oxide semiconductor for the channel layer.

<1.3 High-Level Power Supply Line and Low-Level Power Supply Line>

Figure 6:
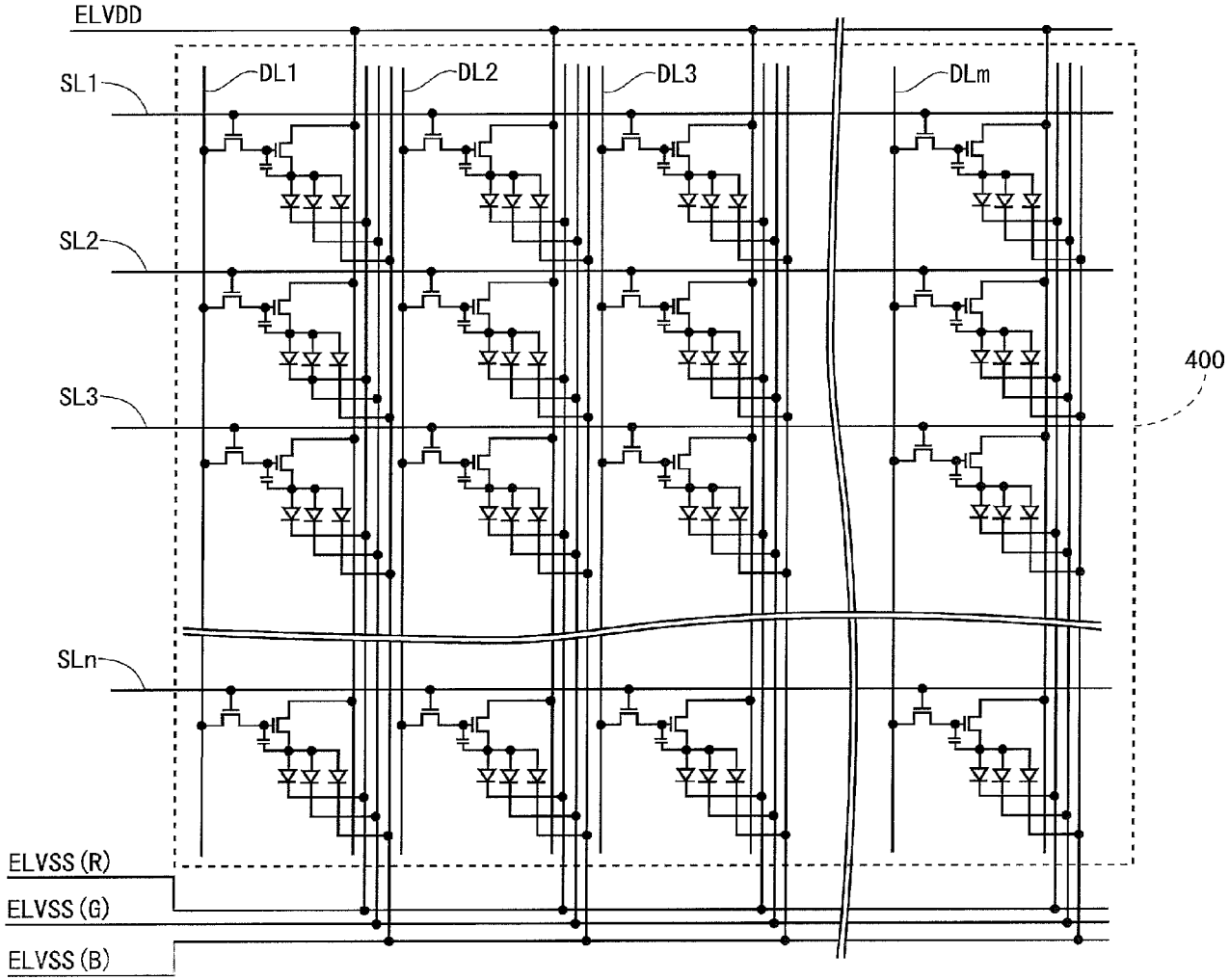
FIG. 6 is a diagram for describing configurations of a high-level power supply line and a low-level power supply line in the first embodiment.

FIG. 6 is a diagram for describing configurations of a high-level power supply line ELVDD and a low-level power supply line ELVSS in the present embodiment. The high-level power supply line ELVDD is configured such that a high-level power supply voltage output from one power supply (an organic EL high-level power supply 510) (see FIG. 2) is supplied to all the pixel circuits 40 in the display unit 400. The red-color organic EL low-level power supply line ELVSS (R) is configured such that a red-color organic EL low-level power supply voltage output from one power supply (the red-color organic EL low-level power supply 520(R)) (see FIG. 2) is supplied to all the pixel circuits 40 in the display unit 400. A configuration similar to that of the red-color organic EL low-level power supply line ELVSS(R) is also applied to the green-color organic EL low-level power supply line ELVSS(G) and the blue-color organic EL low-level power supply line ELVSS(B). Based on such a configuration, when there is a large variation in the red-color organic EL low-level power supply voltage ELVSS(R) output from the red-color organic EL low-level power supply 520(R), for example, a potential on the cathode terminal side of the organic EL element OLED(R) varies in all the pixel circuits 40 in the display unit 400.

It should be noted that, in the present embodiment, a first power supply line is realized by the high-level power supply line ELVDD, and a second power supply line is realized by the low-level power supply line ELVSS.

<1.4 Driving Method>

Figure 7:
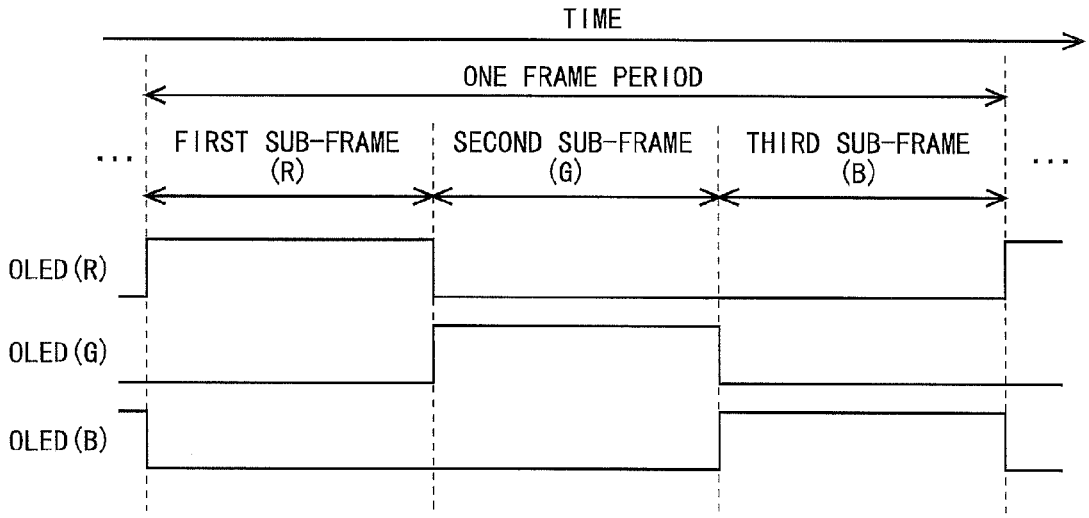
FIG. 7 is a diagram illustrating a configuration of one frame period in the first embodiment.

FIG. 7 is a diagram illustrating a configuration of one frame period in the present embodiment. As illustrated in FIG. 7, one frame period includes three sub-frames (first to third sub-frames). The first sub-frame is a sub-frame for displaying a red color screen image. That is, in the first sub-frame, the organic EL element OLED(R) emits light. The second sub-frame is a sub-frame for displaying a green color screen image. That is, in the second sub-frame, the organic EL element OLED(G) emits light. The third sub-frame is a sub-frame for displaying a blue color screen image. That is, in the third sub-frame, the organic EL element OLED(B) emits light. During the operation of the organic EL display device 1, the first to third sub-frames are repeated. Thus, the red color screen image, the green color screen image, and the blue color screen image are repeatedly displayed so that desired color display is performed.

Figure 8:
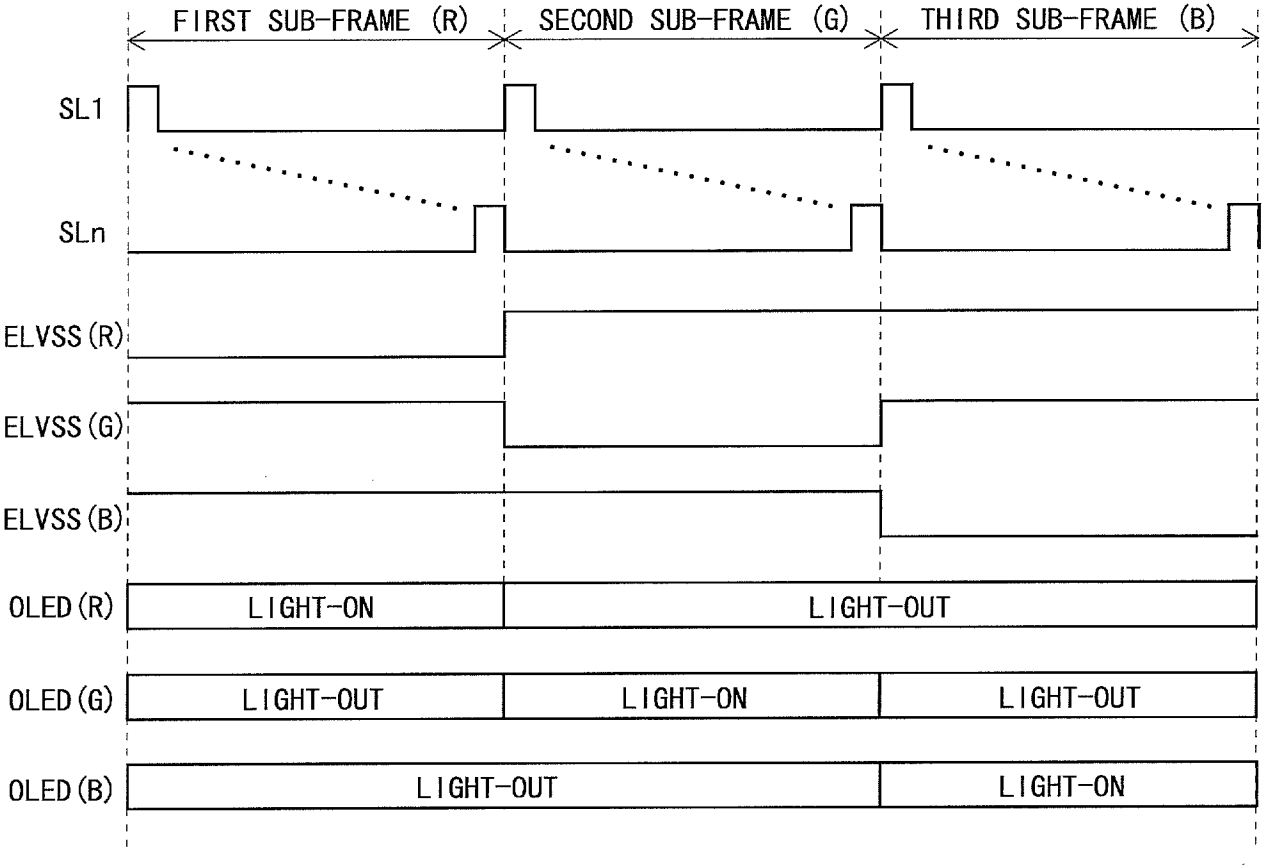
FIG. 8 is a timing chart for describing a driving method in the first embodiment.

FIG. 8 is a timing chart for describing a driving method in the present embodiment. As illustrated in FIG. 8, in each sub-frame, active scanning signals are sequentially applied to the n scanning signal lines SL1 to SLn. That is, in each sub-frame, each one of the n scanning signal lines SL1 to SLm sequentially becomes in a selected state.

In the first sub-frame, the red-color organic EL low-level power supply voltage ELVSS(R) is set to a relatively low level (a second voltage), and the green-color organic EL low-level power supply voltage ELVSS(G) and the blue-color organic EL low-level power supply voltage ELVSS(B) are set to a relatively high level (a first voltage). Moreover, in the pixel circuit 40 corresponding to one pixel, as illustrated in FIG. 1, the organic EL elements OLED(R), OLED(G), and OLED (B) are provided in series with the transistor T1 which is a driving transistor. Cathode terminals of the organic EL elements OLED(R), OLED(G), and OLED(B) are respectively connected to the red-color organic EL low-level power supply line ELVSS(R), the green-color organic EL low-level power supply line ELVSS(G), and the blue-color organic EL low-level power supply line ELVSS(B). Because of the above configuration, in the first sub-frame, a voltage between the anode terminal and the cathode terminal of the organic EL element OLED(R) becomes equal to or higher than a light emission threshold voltage, but a voltage between the anode terminal and the cathode terminal of each of the organic EL element OLED(G) and the organic EL element OLED(B)

becomes less than the light emission threshold voltage. Accordingly, a driving current is supplied to only the organic EL element OLED(R). Therefore, in the first sub-frame, only the organic EL element OLED(R) becomes in the light-on state, and both the organic EL element OLED(G) and the organic EL element OLED(B) become in the light-out state.

In the second sub-frame, the green-color organic EL low-level power supply voltage ELVSS(G) is set to a relatively low level, and both the red-color organic EL low-level power supply voltage ELVSS(R) and the blue-color organic EL low-level power supply voltage ELVSS(B) are set to relatively high levels. Accordingly, in the second sub-frame, a driving current is supplied to only the organic EL element OLED(G), in the same manner as the first sub-frame. That is, in the second sub-frame, only the organic EL element OLED(G) becomes in the light-on state, and both the organic EL element OLED(R) and the organic EL element OLED(B) become in the light-out state.

In the third sub-frame, the blue-color organic EL low-level power supply voltage ELVSS(B) is set to a relatively low level, and both the red-color organic EL low-level power supply voltage ELVSS(R) and the green-color organic EL low-level power supply voltage ELVSS(G) are set to relatively high levels. Accordingly, in the third sub-frame, a driving current is supplied to only the organic EL element OLED (B), in the same manner as the first sub-frame. That is, in the third sub-frame, only the organic EL element OLED(B) becomes in the light-on state, and both the organic EL element OLED(R) and the organic EL element OLED(G) become in the light-out state.

It should be noted that the levels of the red-color organic EL low-level power supply voltage ELVSS(R), the green-color organic EL low-level power supply voltage ELVSS(G), and the blue-color organic EL low-level power supply voltage ELVSS(B) are respectively controlled by the control signals SC(R), SC(G), and SC(B).

In order to realize the above operation, when any sub-frame included in one frame period is assumed as a focused sub-frame, the low-level power supply control unit 110 controls a voltage to be given to each low-level power supply line ELVSS, such that, in the focused sub-frame, a voltage applied to the organic EL element OLED corresponding to the focused sub-frame becomes equal to or higher than a light emission threshold value, and that a voltage applied to the organic EL elements OLED other than the organic EL element OLED corresponding to the focused sub-frame becomes less than the light emission threshold value.

Figure 9:
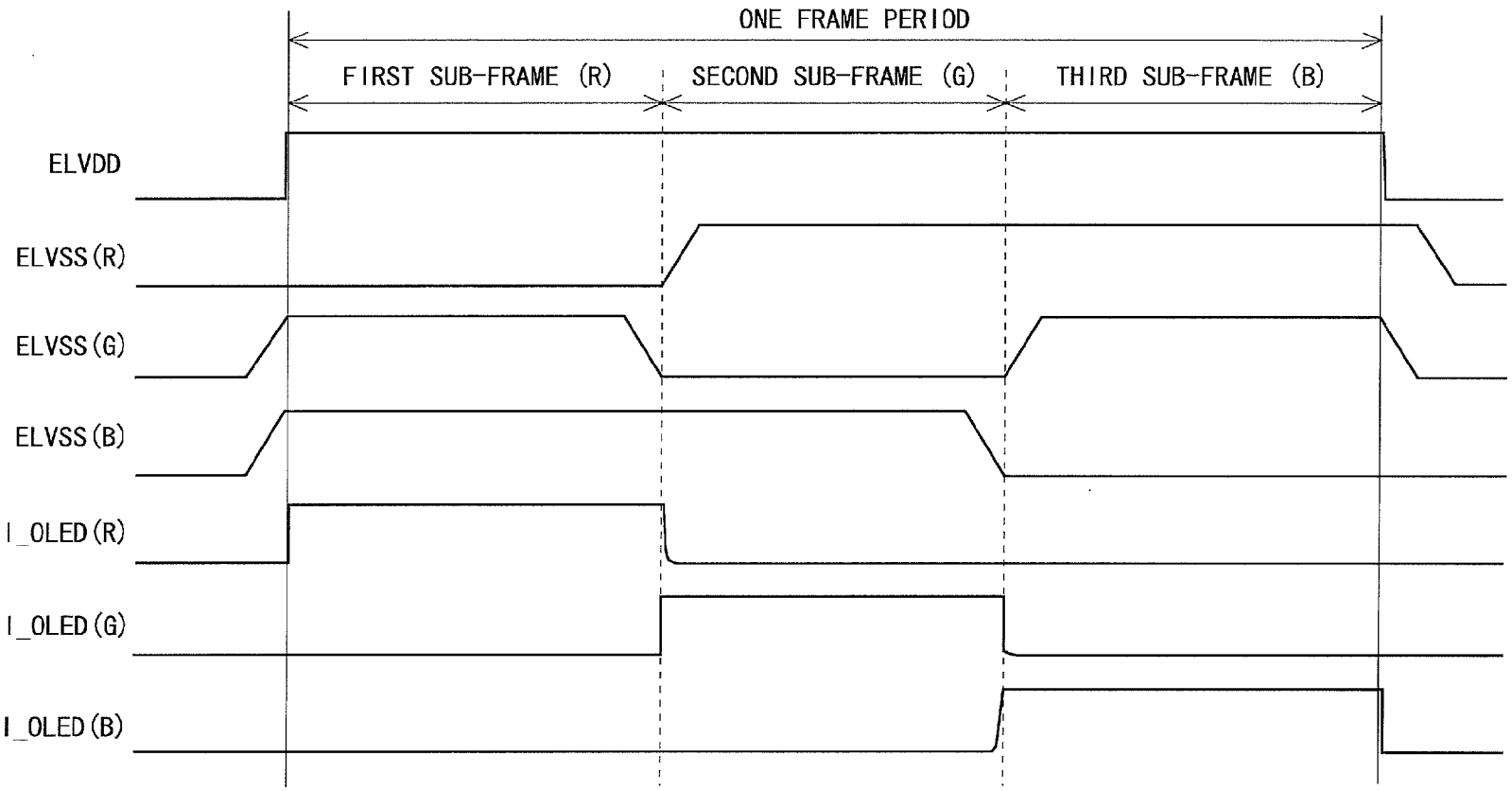
FIG. 9 is a waveform diagram illustrating a simulation result in the first embodiment.

FIG. 9 is a waveform diagram illustrating a simulation result in the present embodiment. In FIG. 9, driving currents that flow in the organic EL elements OLED(R), OLED(G), and OLED(B) are respectively expressed by symbols I_OLED(R), I_OLED(G), and I_OLED(B). In the first sub-frame, by setting only the red-color organic EL low-level power supply voltage ELVSS(R) to a relatively low level, a driving current flows in only the organic EL element OLED (R). In the second sub-frame, by setting only the green-color organic EL low-level power supply voltage ELVSS(G) to a relatively low level, a driving current flows in only the organic EL element OLED(G). In the third sub-frame, by setting only the blue-color organic EL low-level power supply voltage ELVSS(B) to a relatively low level, a driving current flows in only the organic EL element OLED(B).

Figure 10:
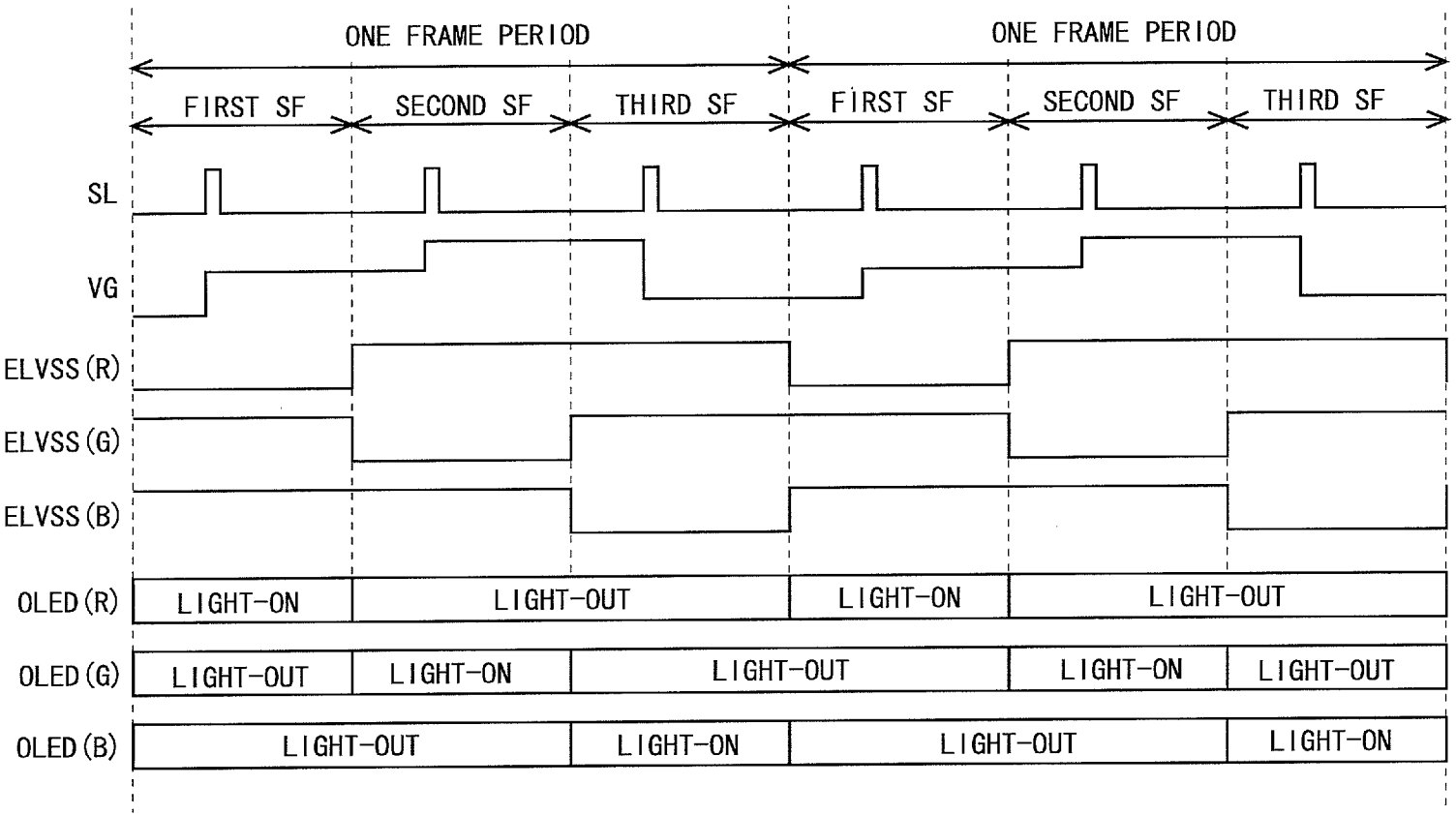
FIG. 10 is a timing chart for describing the operation of a pixel circuit corresponding to one pixel in the first embodiment.

Next, the operation of the pixel circuit 40 corresponding to one pixel will be described in detail with reference to FIG. 1 and FIG. 10. Here, attention will be focused on one pixel included in a k-th row. Note that in FIG. 10, a sub-frame is expressed as "SF". When the scanning signal line SL is in the unselected state, the transistor T2 is in the OFF state, and the potential of the gate node VG maintains a level corresponding to the writing in one preceding sub-frame. When the scanning signal line SL has changed from the unselected state to the selected state, the transistor T2 is turned on. Accordingly, a data voltage of magnitude corresponding to the luminance of the color of the sub-frame at the current time point is supplied to the gate node VG via the data line DL and the transistor T2. Then, during a period when the scanning signal line SL is in the selected state, the capacitor Cst is charged to the gate-source voltage Vgs which is a difference between the potential of the gate node VG and the source potential of the transistor T1. Thereafter, when the scanning signal line SL has changed from the selected state to the unselected state, the transistor T2 is turned off. As a result, the gate-source voltage Vgs held by the capacitor Cst is established. The transistor T1 supplies a driving current to the organic EL element OLED according to the gate-source voltage Vgs held by the capacitor Cst. In this case, a driving current is supplied to the organic EL element OLED(R) in the first sub-frame, a driving current is supplied to the organic EL element OLED(G) in the second sub-frame, a driving current is supplied to the organic EL element OLED(B) in the third sub-frame. As a result, in each pixel, the organic EL element OLED emits light with desired luminance in each sub-frame.

In the organic EL display device 1 employing the pixel circuit 40 having a configuration illustrated in FIG. 1, displaying a desired color image in the display unit 400 is performed by employing the above driving method. That is, although a configuration of the pixel circuit is simpler than the conventional configuration, display quality is not lost.

<1.5 Effects>

Figure 29:
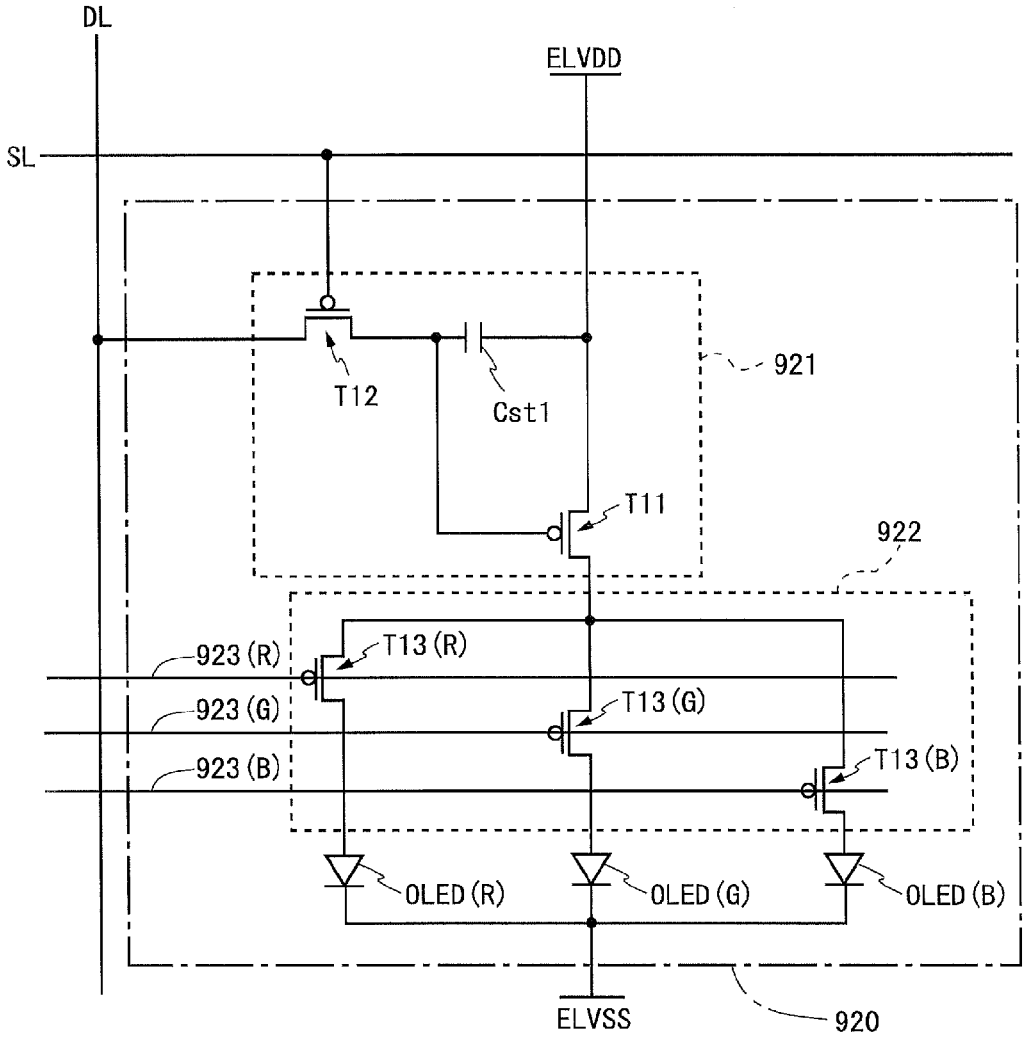
FIG. 29 is a circuit diagram illustrating a configuration of a pixel circuit corresponding to one pixel in a second conventional example.
Figure 30:
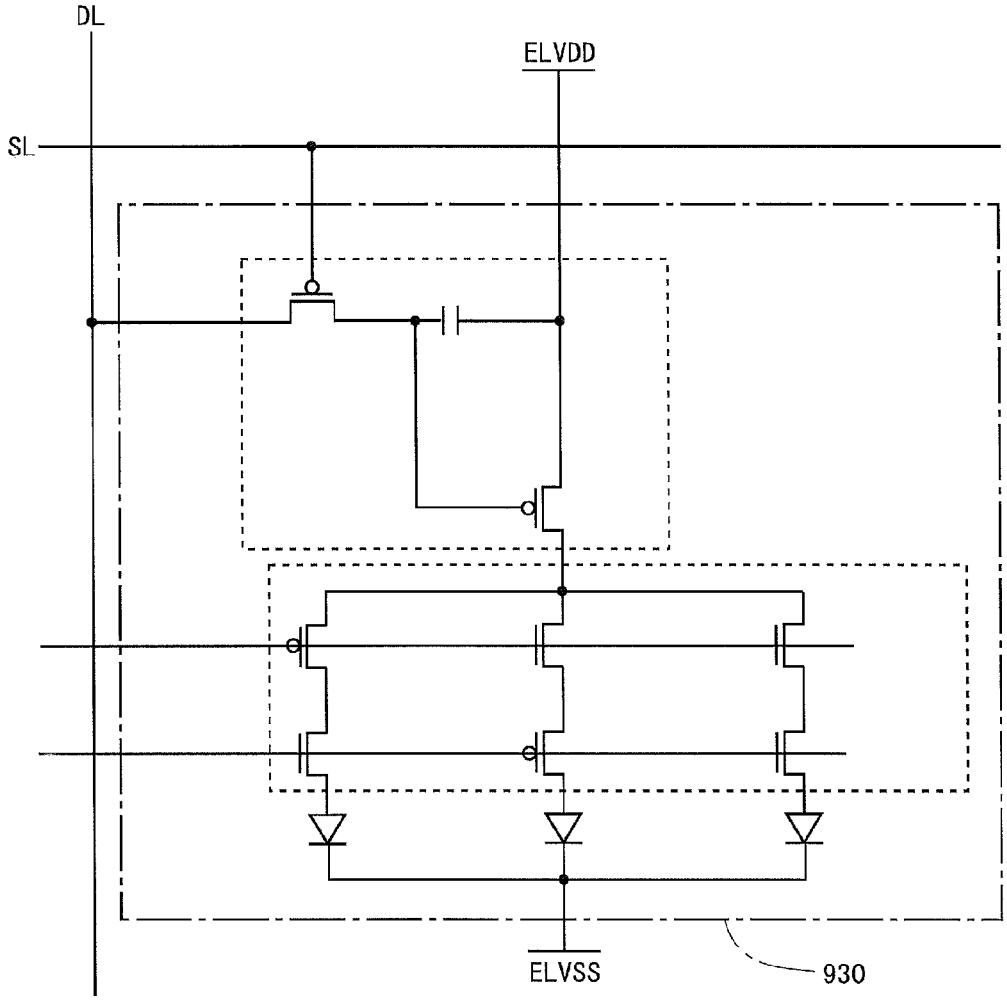
FIG. 30 is a circuit diagram illustrating a configuration of a pixel circuit corresponding to one pixel in a third conventional example.

According to the pixel circuit 920 having the conventional simplest configuration (the second conventional example: see FIG. 29), five transistors have been necessary per one pixel. On the other hand, according to the present embodiment, the number of transistors necessary per one pixel becomes two, as illustrated in FIG. 1. In this way, according to the present embodiment, the number of transistors necessary per one pixel is reduced as compared with the conventional example. That is, the organic EL display device equipped with an organic EL element OLED which is a self light-emitting type display element can be realized by using a pixel circuit having a configuration simpler than the conventional configuration.

Figure 11:
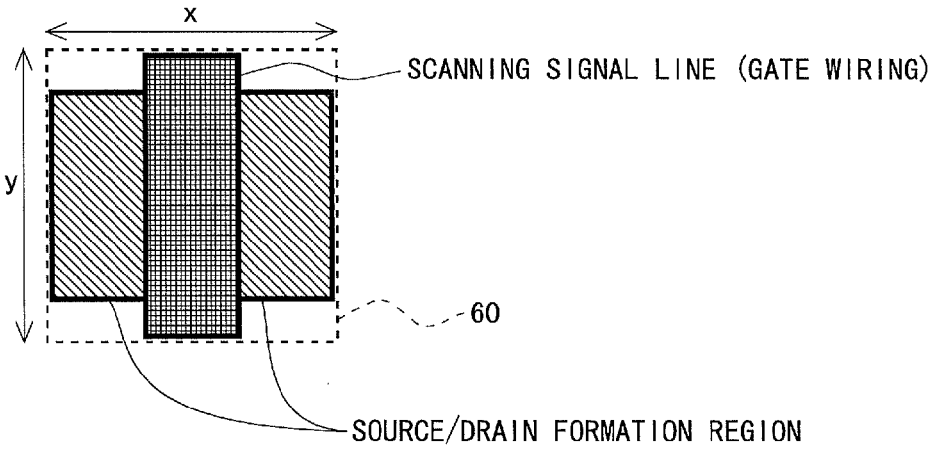
FIG. 11 is a diagram for describing the effects in the first embodiment.
Figure 12:
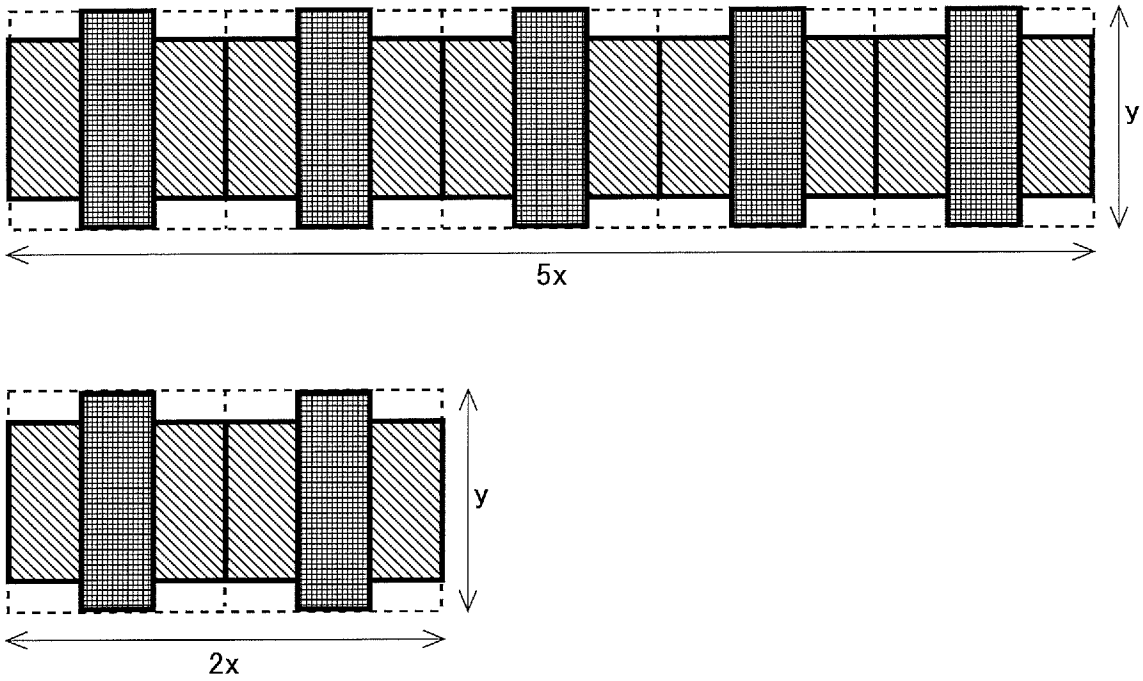
FIG. 12 is a diagram for describing the effects in the first embodiment.

Next, effects in the present embodiment will be quantitatively described. In this case, as illustrated in FIG. 11, a rectangular region including a scanning signal line (gate wiring) and a source/drain region will be expressed as a TFT occupation region 60. Further, a length of each side of the TFT occupation region 60 will be expressed as x and y as illustrated in FIG. 11. Then, as illustrated in FIG. 12, while the TFT occupation area in the second conventional example is 5xy, the TFT occupation area in the present embodiment is 2xy. Therefore, a ratio (a TFT occupation area ratio) P1 of the TFT occupation area in the present embodiment to the TFT occupation area in the second conventional example becomes as follows.

$$P1 = (2xy/5xy) \times 100$$
$$= 40\ (\%)$$

As described above, according to the present embodiment, the TFT occupation area becomes 40 percent of that in the second conventional example.

Figure 13:
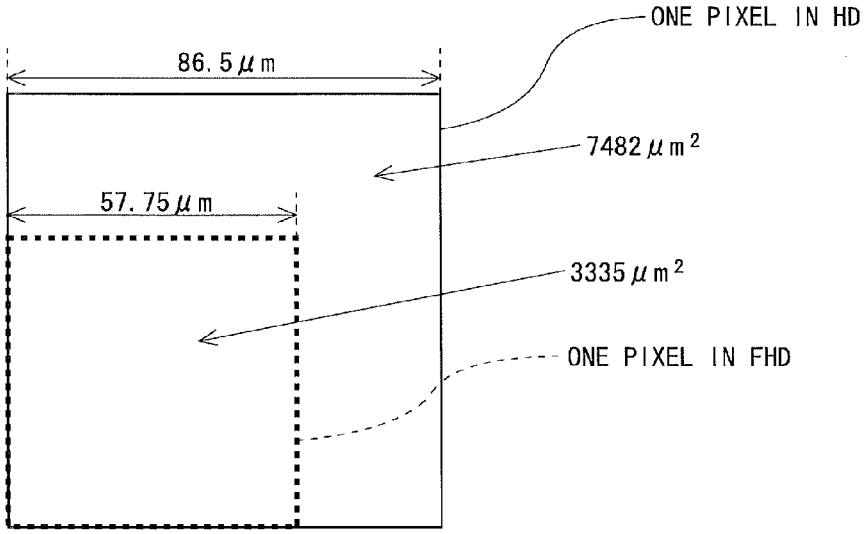
FIG. 13 is a diagram for describing the effects in the first embodiment.

As can be understood from FIG. 31, concerning the 5.0-inch panel, a ratio (a pixel area ratio) of the area of one pixel (3335 square micrometers) in the FHD to the area of one pixel (7482 square micrometers) in the HD is 45 percent (also see FIG. 13).

As described above, when an HD panel has been enhanced to an FHD, a pixel area after the enhancement to the FHD becomes 45 percent of the pixel area before the enhancement to the FHD. Further, according to the present embodiment, the TFT occupation area becomes 40 percent of that in the second conventional example. From the above, when the HD panel has been realized by using the second conventional example, a panel of the same size can be easily enhanced to the FHD by employing the configuration of the pixel circuit 40 in the present embodiment. Similarly, by employing the configuration of the pixel circuit 40 in the present embodiment, an FHD panel can be enhanced to WQHD, and a WQHD panel can be enhanced to 2k4k.

Although the effects have been described by focusing attention on only the TFT occupation area, according to the present embodiment, the light-emission control lines 923(R), 923(G), and 923(B) necessary in the second conventional example also become unnecessary. Taking this point into account, by employing the configuration of the pixel circuit 40 in the present embodiment, it becomes easier to achieve ultra definition enhancement of the panel.

Further, according to the present embodiment, as the transistors T1 and T2 in the pixel circuit 40, there is employed an oxide TFT (a thin-film transistor having an oxide semiconductor used for the channel layer) such as an IGZO-TFT. Therefore, miniaturization of the TFT in the pixel circuit 40 has become possible, and it becomes easier to achieve ultra definition enhancement of the panel.

It should be noted that, in each row, until the time point when writing is performed in each sub-frame, the organic EL element OLED emits light with the luminance corresponding to the writing in one preceding sub-frame. Focusing attention on a k-th row, for example, until the time point when writing is performed in the second sub-frame, the green-color organic EL element OLED(G) emits light with the luminance corresponding to the writing in the first sub-frame (see FIG. 10). Therefore, it is considered that a desired color image may not be displayed. However, in the present embodiment, because one frame period includes three sub-frames, when the display is in 60 Hz, a substantial driving frequency becomes 180 Hz. Because a high speed driving is performed in this way, even when the organic EL element OLED emits light with the luminance corresponding to the writing in one preceding sub-frame, the organic EL element OLED immediately emits light with the original luminance. Therefore, a desired color image is visually recognized by the human eyes. It should be noted that, concerning this point, a configuration for preventing the organic EL element OLED from emitting light with the luminance corresponding to the writing in one preceding sub-frame will be described in a third embodiment.

<1.6 Modification>

In the first embodiment, display is performed in the order of "the red color screen image, the green color screen image, and the blue color screen image", but the present invention is not limited thereto. The display may be performed in the order of "the red color screen image, the blue color screen image, and the green color screen image". This will be described below.

Figure 14:
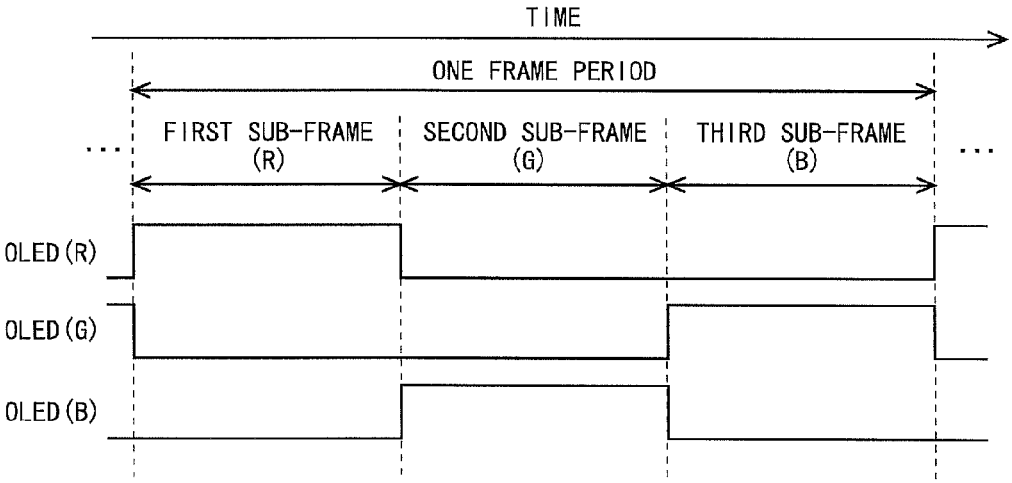
FIG. 14 is a diagram illustrating a configuration of one frame period in a modification of the first embodiment.

FIG. 14 is a diagram illustrating a configuration of one frame period in the present modification. In the present modification, the organic EL element OLED(R) emits light in the first sub-frame, the organic EL element OLED(B) emits light in the second sub-frame, and the organic EL element OLED (G) emits light in the third sub-frame.

Figure 15:
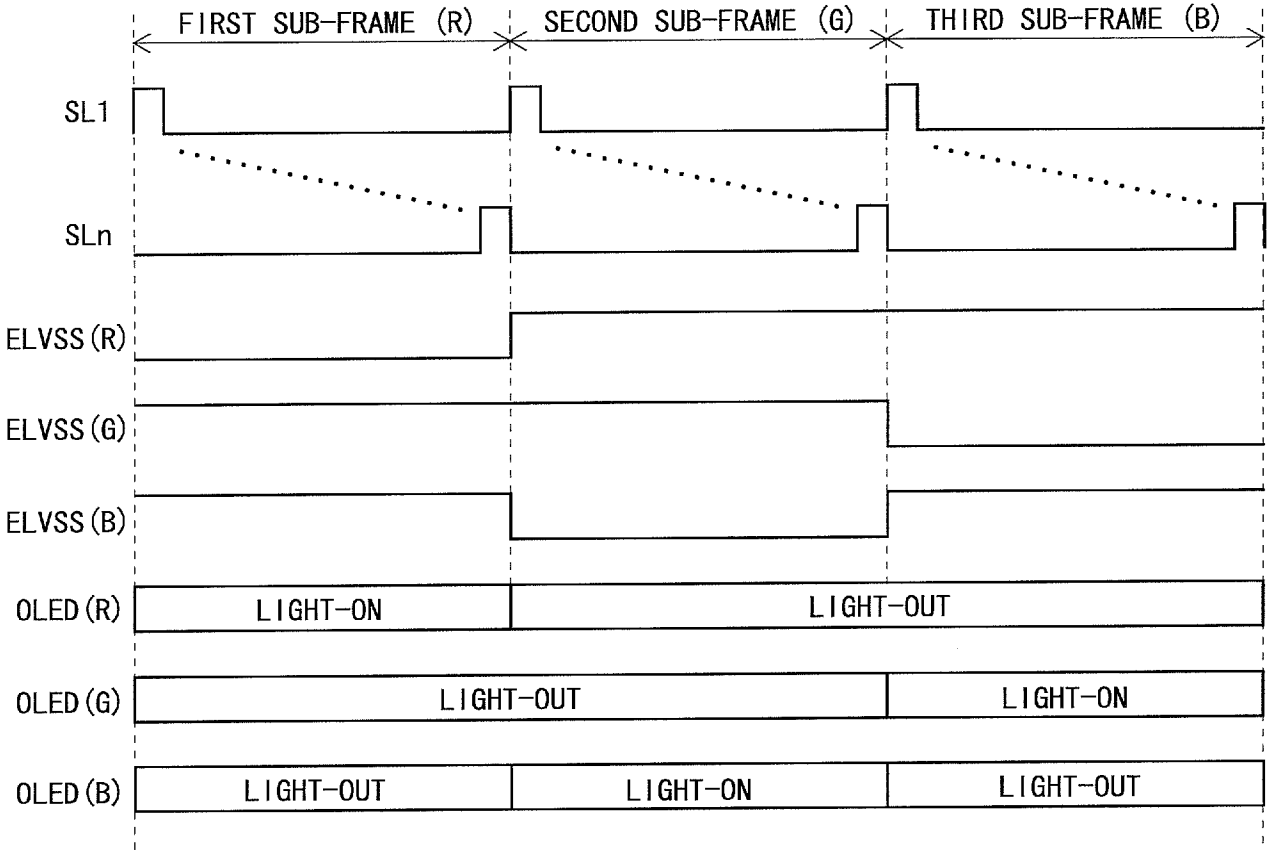
FIG. 15 is a timing chart for describing a driving method in the modification of the first embodiment.

FIG. 15 is a timing chart for describing a driving method in the present modification. In the first sub-frame, only the organic EL element OLED(R) becomes in the light-on state, and both the organic EL element OLED(G) and the organic EL element OLED(B) become in the light-out state, in the same manner as the first embodiment. In the second sub-frame, only the organic EL element OLED(B) becomes in the light-on state, and both the organic EL element OLED(R) and the organic EL element OLED(G) become in the light-out state, in the same manner as the third sub-frame in the first embodiment. In the third sub-frame, only the organic EL element OLED(G) becomes in the light-on state, and both the organic EL element OLED(R) and the organic EL element OLED(B) become in the light-out state, in the same manner as the second sub-frame in the first embodiment.

Even when the display is performed in the order of "the red color screen image, the blue color screen image, and the green color screen image" as described above, the effects similar to those in the first embodiment can be obtained. It should be noted that, also in the second embodiment and the third embodiment, the order of colors to be displayed is not particularly limited.

<2. Second Embodiment>

<2.1 Overall Configuration>

Figure 16:
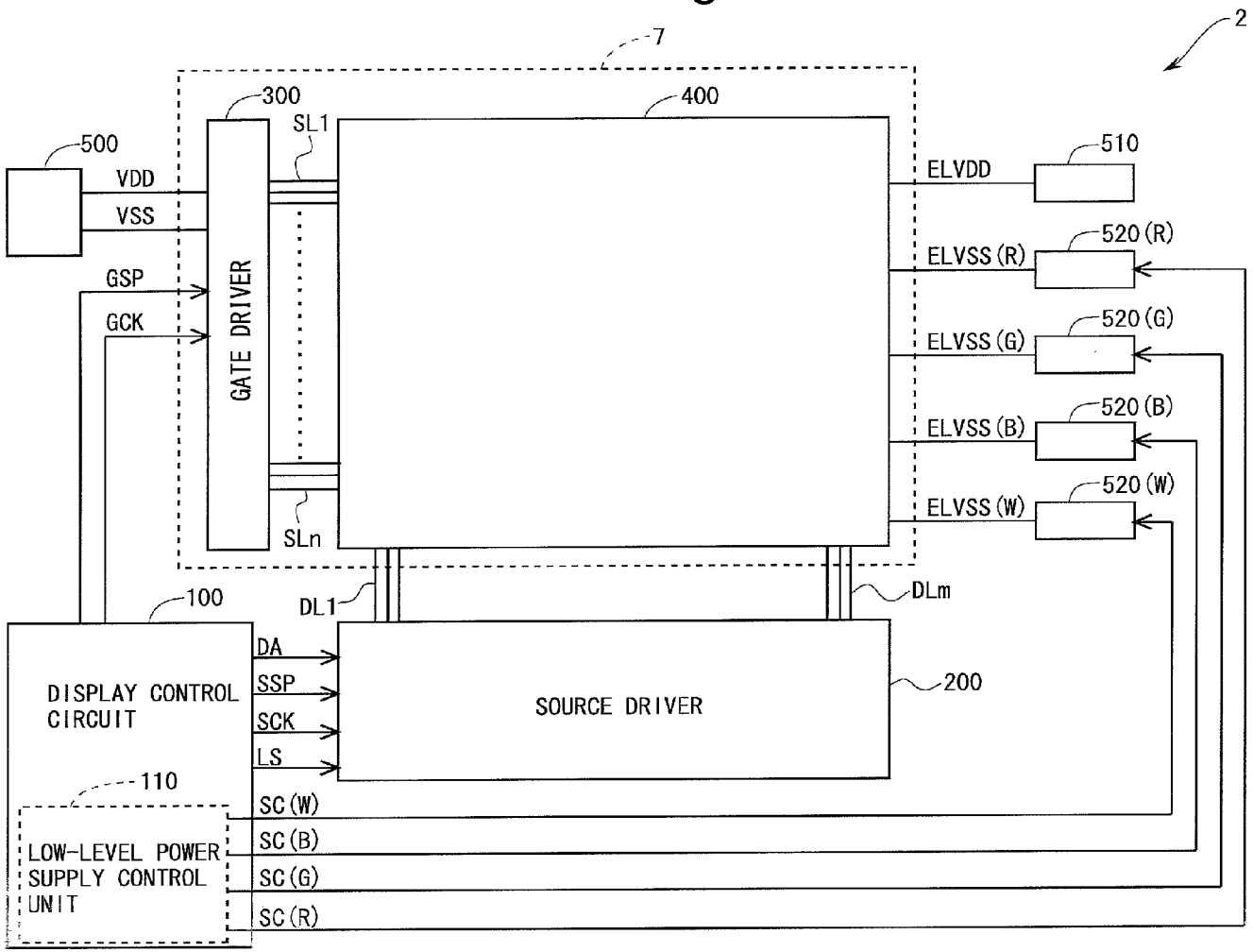
FIG. 16 is a block diagram illustrating an overall configuration of an active matrix-type organic EL display device according to a second embodiment of the present invention.

FIG. 16 is a block diagram illustrating an overall configuration of an active matrix-type organic EL display device 2 according to a second embodiment of the present invention. It should be noted that only different points from the first embodiment will be described, and description of points similar to those in the first embodiment will be omitted.

In the active matrix-type organic EL display device 2 according to the present embodiment, a white-color organic EL low-level power supply 520(W) is provided in addition to the components in the first embodiment. The white-color organic EL low-level power supply 520(W) supplies, to the organic EL panel 7, a white-color organic EL low-level power supply voltage ELVSS(W). It should be noted that a power supply line for supplying the white-color organic EL low-level power supply voltage ELVSS(W) will be hereinafter referred to as a "white-color organic EL low-level power supply line". The white-color organic EL low-level power supply line will be designated with the same symbol ELVSS (W) as that given to the white-color organic EL low-level power supply voltage. In order to control the level of the white-color organic EL low-level power supply voltage ELVSS(W), a control signal SC(W) is transmitted from the display control circuit 100 to the white-color organic EL low-level power supply 520(W).

<2.2 Configuration of Pixel Circuit>

Figure 17:
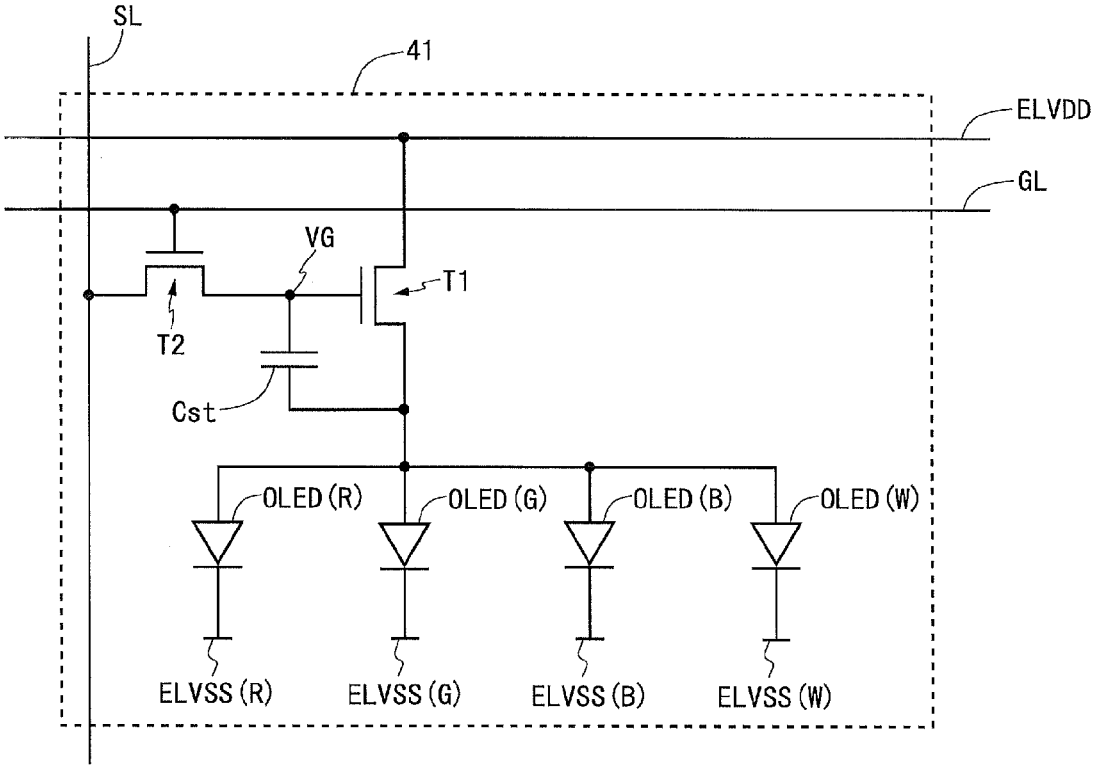
FIG. 17 is a circuit diagram illustrating a configuration of a pixel circuit corresponding to one pixel in the second embodiment.

FIG. 17 is a circuit diagram illustrating a configuration of a pixel circuit 41 corresponding to one pixel in the present embodiment. As illustrated in FIG. 17, in the present embodiment, an organic EL element OLED(W) is provided in addition to the components (see FIG. 1) in the first embodiment in the pixel circuit 41. The organic EL element OLED(W) functions as an electro-optical element that emits white color light. An anode terminal of the organic EL element OLED (W) is connected to a source terminal of the transistor T1, and a cathode terminal of the organic EL element OLED(W) is connected to a white-color organic EL low-level power supply line ELVSS(W).

<2.3 High-Level Power Supply Line and Low-Level Power Supply Line>

The high-level power supply line ELVDD, the red-color organic EL low-level power supply line ELVSS(R), the green-color organic EL low-level power supply line ELVSS (G), and the blue-color organic EL low-level power supply line ELVSS(B) are configured in a similar manner to those in the first embodiment (see FIG. 6). Further, in the present embodiment, the white-color organic EL low-level power supply line ELVSS(W) is configured such that the white-color organic EL low-level power supply voltage output from one power supply (the white-color organic EL low-level power supply 520(W)) is supplied to all the pixel circuits 41 in the display unit 400.

<2.4 Driving Method>

Figure 18:
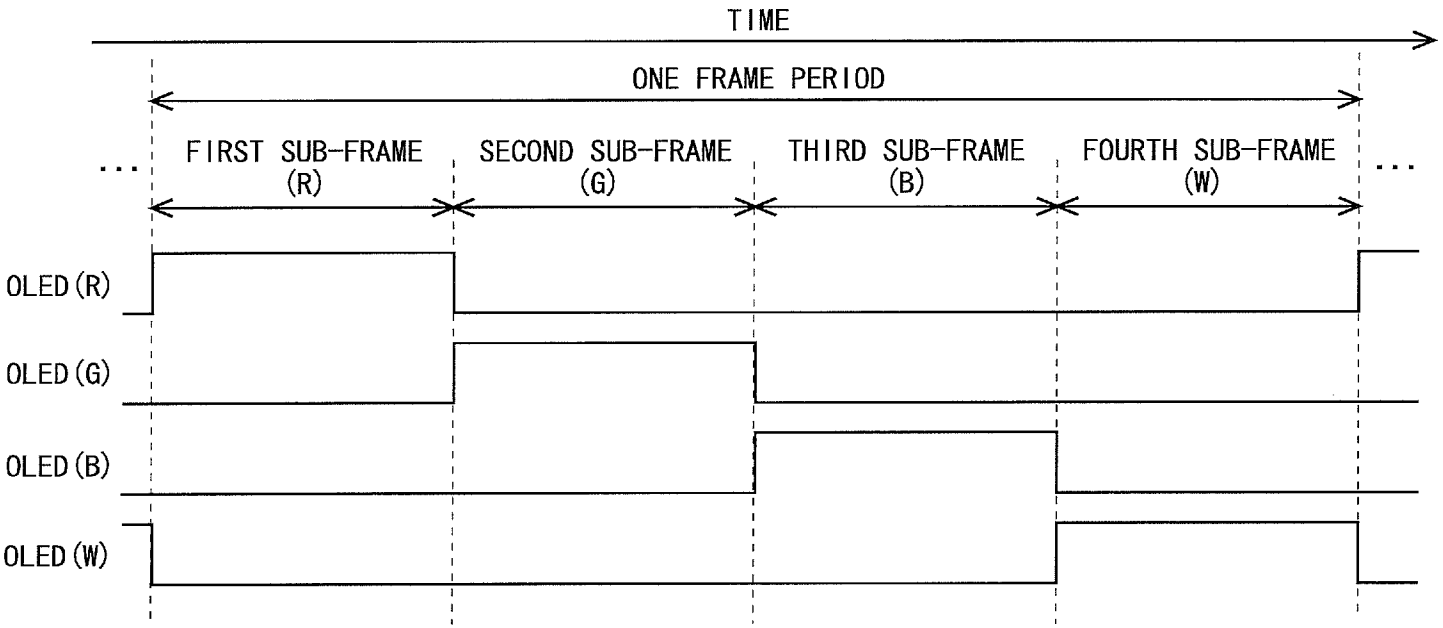
FIG. 18 is a diagram illustrating a configuration of one frame period in the second embodiment.

FIG. 18 is a diagram illustrating a configuration of one frame period in the present embodiment. As illustrated in FIG. 18, in the present embodiment, one frame period includes four sub-frames (first to fourth sub-frames). The first to third sub-frames are similar to those in the first embodiment. The fourth sub-frame is a sub-frame for displaying a white color screen image. That is, in the fourth sub-frame, the organic EL element OLED(W) emits light. During the operation of the organic EL display device 2, the first to fourth sub-frames are repeated. Thus, the red color screen image, the green color screen image, the blue color screen image, and the white color screen image are repeatedly displayed so that desired color display is performed.

Figure 19:
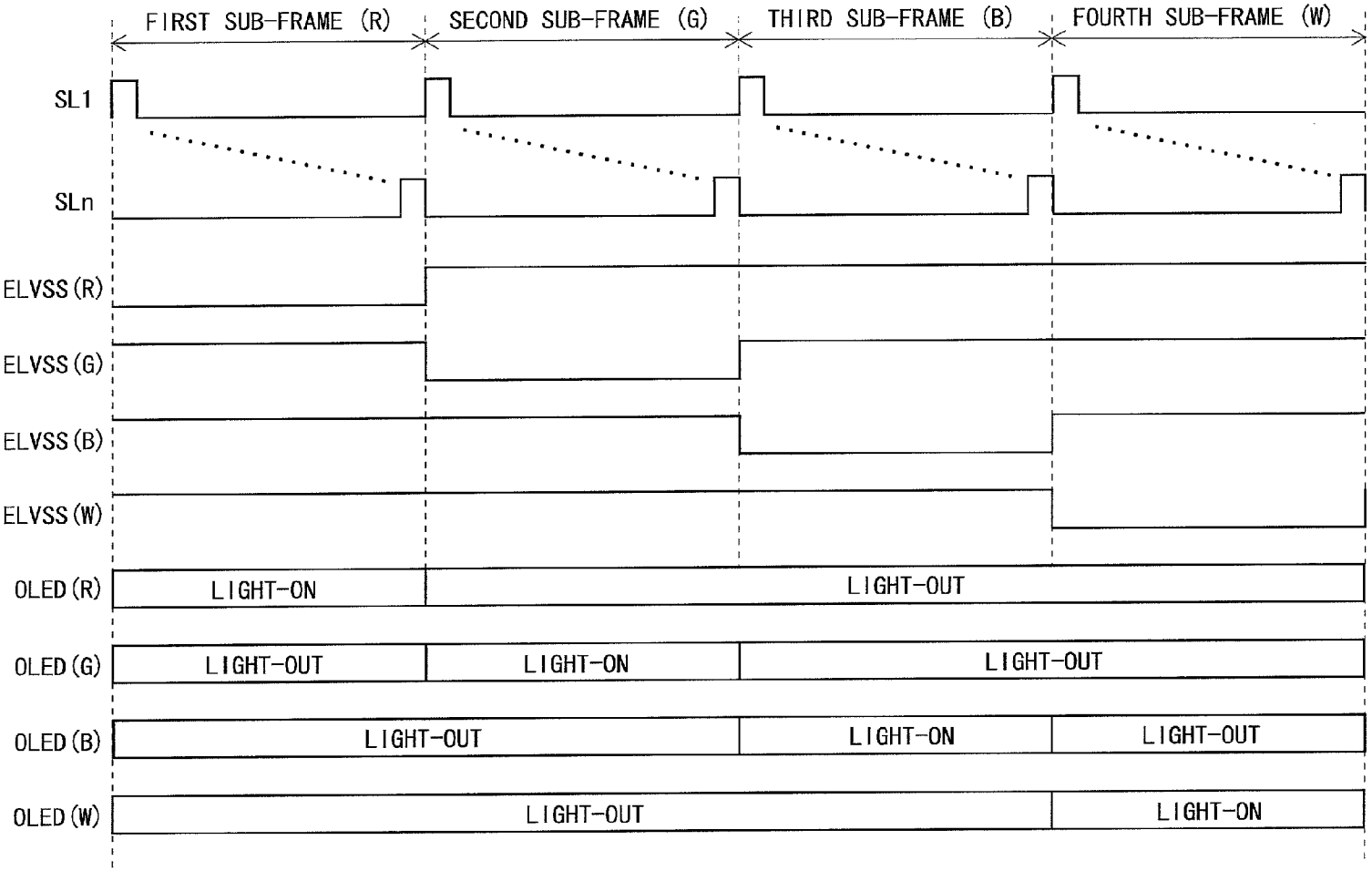
FIG. 19 is a timing chart for describing a driving method in the second embodiment.

FIG. 19 is a timing chart for describing a driving method in the present embodiment. As illustrated in FIG. 19, in each sub-frame, active scanning signals are sequentially applied to the n scanning signal lines SL1 to SLn. That is, in the same manner as the first embodiment, in each sub-frame, each one of the n scanning signal lines SL1 to SLn sequentially becomes in a selected state.

In the first sub-frame, only the red-color organic EL low-level power supply voltage ELVSS(R) out of the low-level power supply voltages ELVSS is set to a relatively low level. Thus, a driving current is supplied to only the organic EL element OLED(R) in the same manner as the first embodiment. Therefore, in the first sub-frame, only the organic EL element OLED(R) becomes in the light-on state, and the organic EL element OLED(G), the organic EL element OLED(B), and the organic EL element OLED(W) become in the light-out state.

In the second sub-frame, only the green-color organic EL low-level power supply voltage ELVSS(G) out of the low-level power supply voltages ELVSS is set to a relatively low level. Thus, a driving current is supplied to only the organic EL element OLED(G) in the same manner as the first embodiment. Therefore, in the second sub-frame, only the organic EL element OLED(G) becomes in the light-on state, and the organic EL element OLED(R), the organic EL element OLED(B), and the organic EL element OLED(W) become in the light-out state.

In the third sub-frame, only the blue-color organic EL low-level power supply voltage ELVSS(B) out of the low-level power supply voltages ELVSS is set to a relatively low level. Thus, a driving current is supplied to only the organic EL element OLED(B) in the same manner as the first embodiment. Therefore, in the third sub-frame, only the organic EL element OLED(B) becomes in the light-on state, and the organic EL element OLED(R), the organic EL element OLED(G), and the organic EL element OLED(W) become in the light-out state.

In the fourth sub-frame, only the white-color organic EL low-level power supply voltage ELVSS(W) out of the low-level power supply voltages ELVSS is set to a relatively low level. Thus, a driving current is supplied to only the organic EL element OLED(W). Therefore, in the fourth sub-frame, only the organic EL element OLED(W) becomes in the light-on state, and the organic EL element OLED(R), the organic EL element OLED(G), and the organic EL element OLED(B) become in the light-out state.

In the organic EL display device 2 employing the pixel circuit 41 having a configuration illustrated in FIG. 17, displaying a desired color image in the display unit 400 is performed by employing the above driving method. That is, although a configuration of the pixel circuit is simpler than the conventional configuration, display quality is not lost.

<2.5 Effects>

When the second conventional example is applied to the organic EL display device in which one pixel includes four sub-pixels, six transistors are necessary per one pixel. On the other hand, according to the present embodiment, the number of transistors necessary per one pixel becomes two, as illustrated in FIG. 17. In this way, according to the present embodiment, the number of transistors necessary per one pixel is reduced as compared with the conventional example. That is, the organic EL display device in which one pixel includes four sub-pixels can be realized by using a pixel circuit having a configuration simpler than the conventional configuration.

Figure 20:
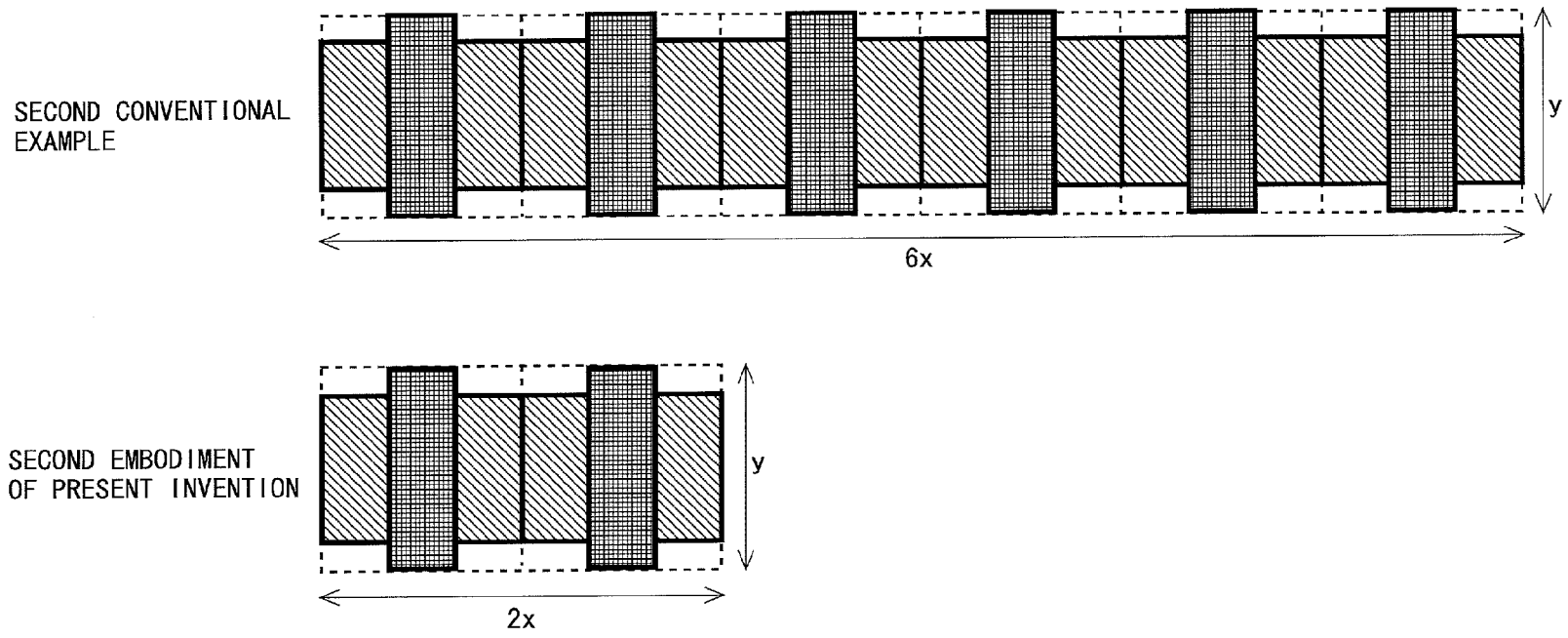
FIG. 20 is a diagram for describing the effects in the second embodiment.

Next, effects in the present embodiment will be quantitatively described. It should be noted that, as illustrated in FIG. 11, a rectangular region including a scanning signal line (gate wiring) and a source/drain region will be expressed as the TFT occupation region 60, and a length of each side of the TFT occupation region 60 will be expressed as x and y. Then, as illustrated in FIG. 20, while the TFT occupation area in the second conventional example is 6xy, the TFT occupation area in the present embodiment is 2xy. Therefore, a ratio (a TFT occupation area ratio) P2 of the TFT occupation area in the present embodiment to the TFT occupation area in the second conventional example becomes as follows.

$$P2 = (2xy/6xy) \times 100$$
$$= 33\ (\%)$$

As described above, according to the present embodiment, the TFT occupation area becomes 33 percent of that in the second conventional example. Moreover, as described above, concerning the 5.0-inch panel, a ratio (a pixel area ratio) of the area of one pixel (3335 square micrometers) in the FHD to the area of one pixel (7482 square micrometers) in the HD is 45 percent (see FIG. 13 and FIG. 31).

As described above, when an HD panel has been enhanced to an FHD, a pixel area after the enhancement to the FHD becomes 45 percent of the pixel area before the enhancement to the FHD. Further, according to the present embodiment, the TFT occupation area becomes 33 percent of that in the second conventional example. From the above, concerning the organic EL display device in which one pixel includes four sub-pixels, when the HD panel has been realized by using the second conventional example, a panel of the same size can be easily enhanced to the FHD by employing the configuration of the pixel circuit 41 in the present embodiment. Similarly, concerning the organic EL display device in which one pixel includes four sub-pixels, by employing the configuration of the pixel circuit 41 in the present embodiment, an FHD panel can be enhanced to WQHD, and a WQHD panel can be enhanced to 2k4k. Note that, according to the present embodiment, the light-emission control line which is necessary in the second conventional example becomes unnecessary. Taking this point into account, by employing the configuration of the pixel circuit 41 in the present embodiment, it becomes easier to achieve ultra definition enhancement of the panel.

<3. Third Embodiment>

<3.1 Overall Configuration and Others

Figure 21:
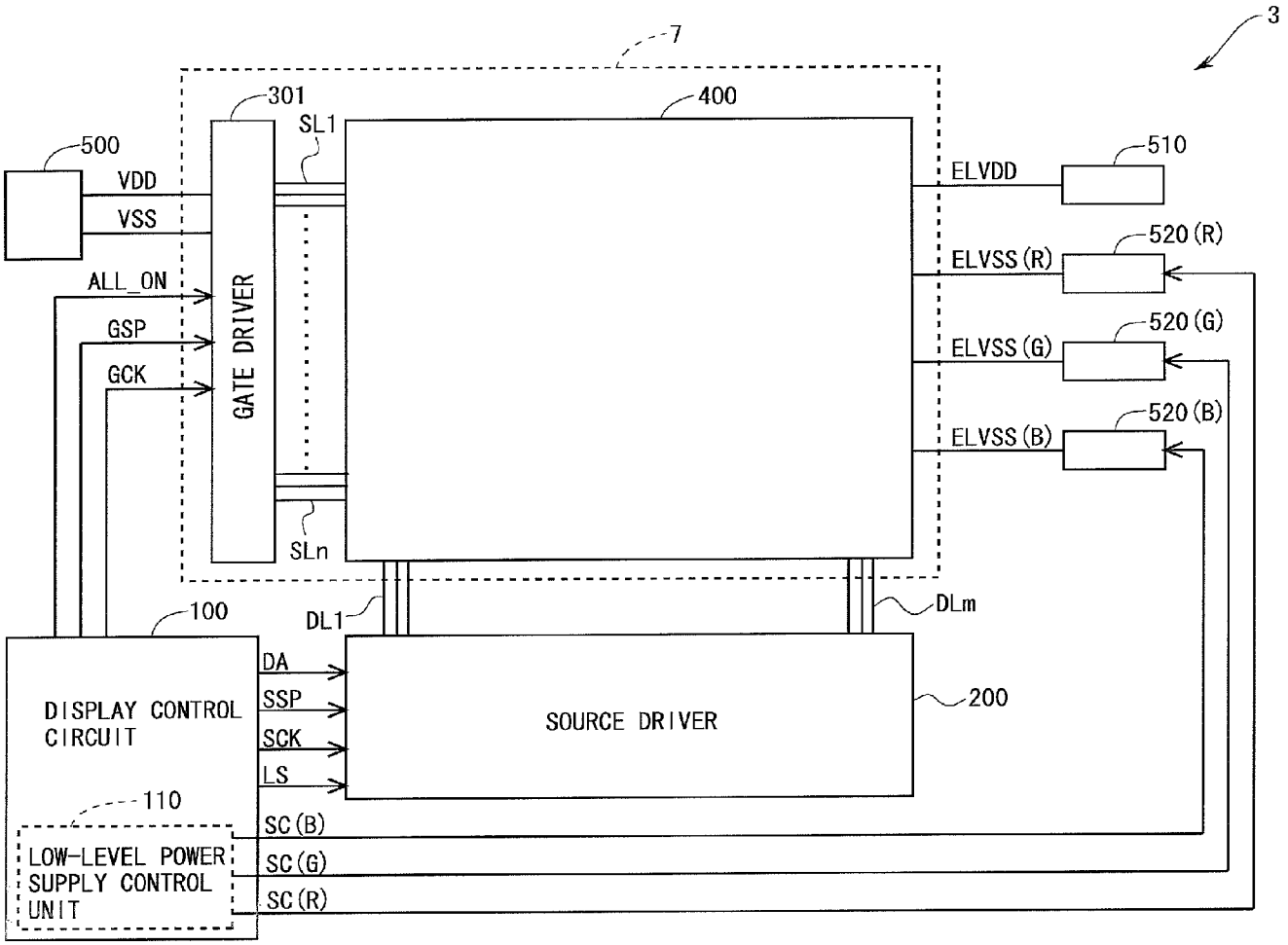
FIG. 21 is a block diagram illustrating an overall configuration of an active matrix-type organic EL display device according to a third embodiment of the present invention.

FIG. 21 is a block diagram illustrating an overall configuration of an active matrix-type organic EL display device 3 according to a third embodiment of the present invention. It should be noted that only different points from the first embodiment will be described, and description of points similar to those in the first embodiment will be omitted. In the present embodiment, a configuration of the gate driver is different from that in the first embodiment. In the present embodiment, the display control circuit 100 transmits an all selection signal ALL_ON to a gate driver 301, in addition to the gate start pulse signal GSP and the gate clock signal GCK.

The gate driver 301 sequentially applies active scanning signals to the n scanning signal lines SL1 to SLn during a valid video period of each sub-frame, based on the gate start pulse signal GSP and the gate clock signal GCK transmitted from the display control circuit 100. The gate driver 301 simultaneously applies active scanning signals to the n scanning signal lines SL1 to SLn during a part of a flyback period of each sub-frame, based on the all selection signal ALL_ON transmitted from the display control circuit 100. It should be noted that, in the present specification, writing data corresponding to black display separately from the original video data will be referred to as "black insertion".

Figure 22:
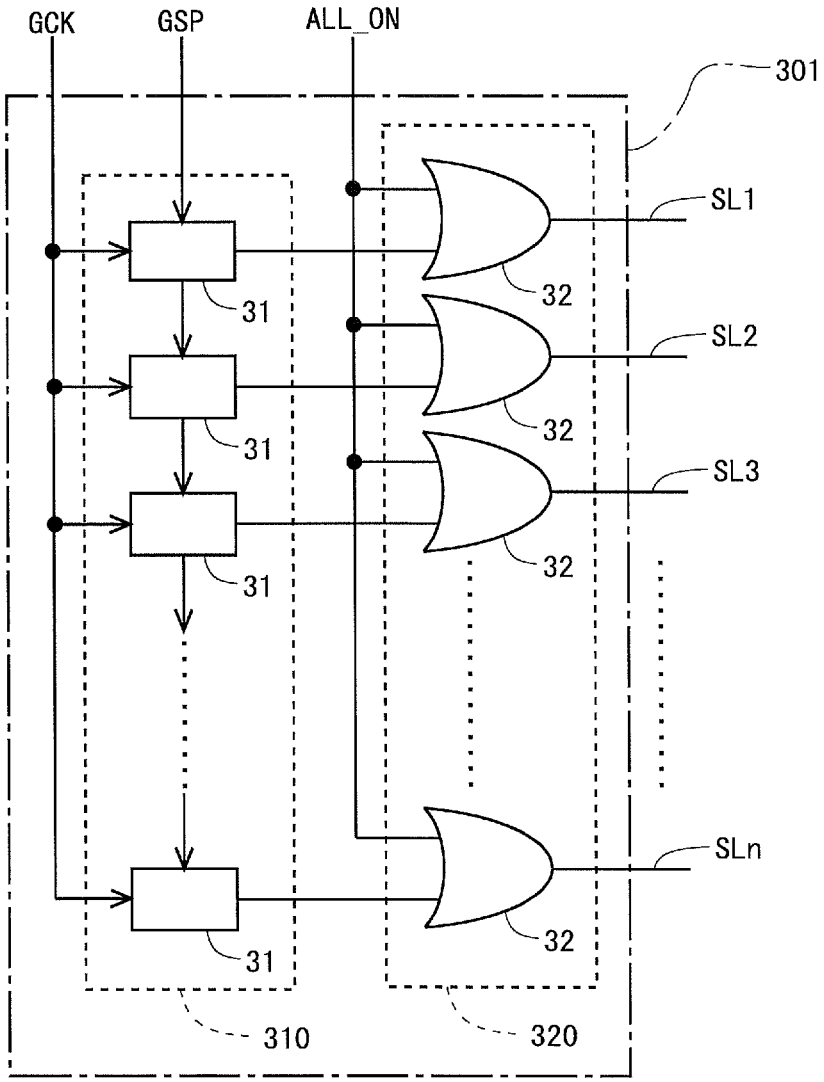
FIG. 22 is a block diagram illustrating a configuration of a gate driver in the third embodiment.

FIG. 22 is a block diagram illustrating a configuration of the gate driver 301 in the present embodiment. The gate driver 301 includes a shift register 310 including n flip-flop circuits 31, and a black insertion control unit 320 for controlling black insertion. In the black insertion control unit 320, n OR circuits 32 are provided so as to correspond, in a one-to-one manner, to the flip-flop circuits 31 in the shift register 310. To the OR circuit 32, the output signal from the flip-flop circuit 31 and the all selection signal ALL_ON are inputted. The output signal from the OR circuit 32 is given, as a scanning signal, to the scanning signal line SL. The shift register 310 is configured in the same manner as the first embodiment such that the gate start pulse signal GSP is given to the first stage flip-flop circuit 31, and the gate clock signal GCK is given in common to all the flip-flop circuits 31.

Figure 23:
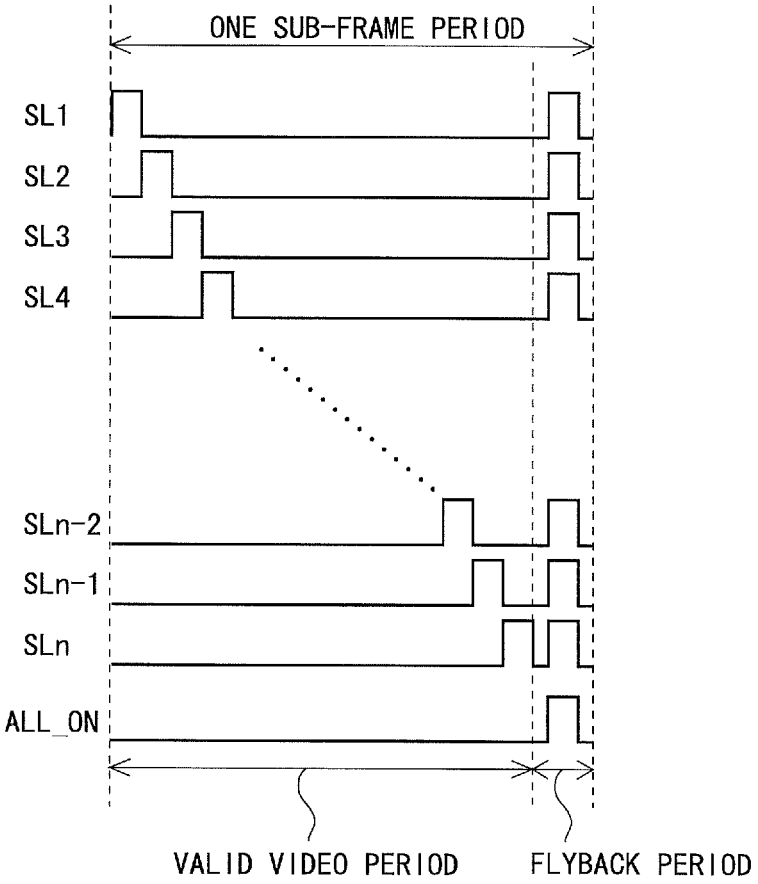
FIG. 23 is a timing chart for describing the operation of a gate driver in the third embodiment.

In the above configuration, immediately after each sub-frame is started, a pulse of the gate start pulse signal GSP is given to the first stage flip-flop circuit 31 of the shift register 310. Consequently, based on the gate clock signal GCK, the pulse included in the gate start pulse signal GSP is sequentially transferred from the first stage flip-flop circuit 31 to the n-th stage flip-flop circuit 31. Then, based on this transfer of the pulse, output signals from the first stage to n-th stage flip-flop circuits 31 sequentially become at high levels. At this time, by maintaining the all selection signal ALL_ON at the low level, active scanning signals are sequentially applied to the n scanning signal lines SL1 to SLn (see FIG. 23). Further, as illustrated in FIG. 23, the all selection signal ALL_ON is set to the high level during a part of the flyback period of each sub-frame. As a result, active scanning signals are simultaneously applied to the n scanning signal lines SL1 to SLn. Note that, during the flyback period of each sub-frame, an analog voltage corresponding to the black color is applied, as a driving video signal, to all the data lines DL1 to DLm (to be described in detail later).

In the present embodiment, the configuration of the pixel circuit 40, the configuration of the high-level power supply line ELVDD, and the configuration of the low-level power supply line ELVSS are similar to those in the first embodiment (see FIG. 1 and FIG. 6).

<3.2 Driving Method>

Figure 24:
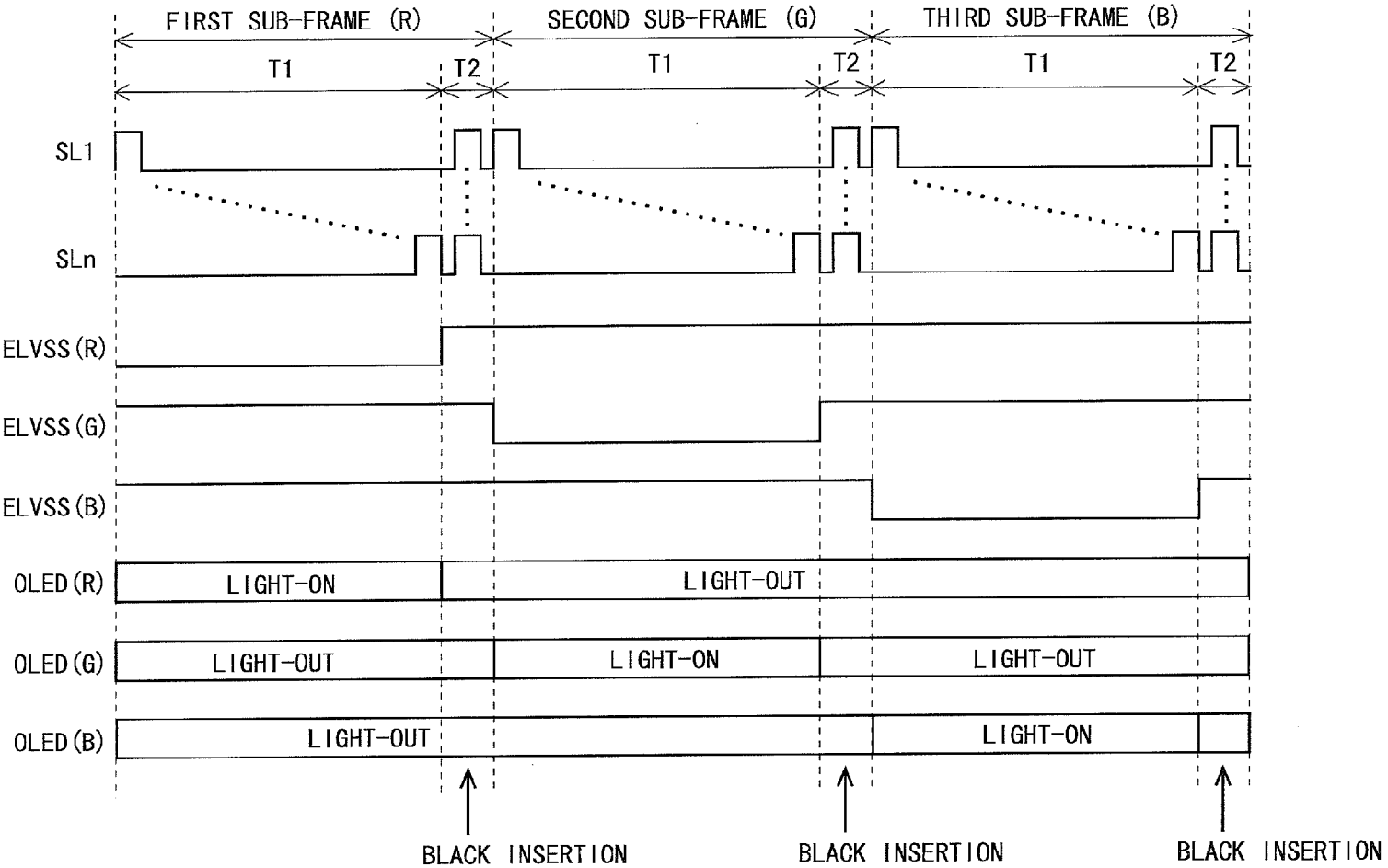
FIG. 24 is a timing chart for describing a driving method in the third embodiment.

Next, a driving method according to the present embodiment will be described. In the present embodiment, in the same manner as the first embodiment, one frame period includes three sub-frames (first to third sub-frames) as illustrated in FIG. 7. FIG. 24 is a timing chart for describing a driving method in the present embodiment. In the present embodiment, as illustrated in FIG. 24, each one of the n scanning signal lines SL1 to SLn becomes sequentially in the selected state during the valid video period T1 of each sub-frame, and the n scanning signal lines SL1 to SLn become simultaneously in the selected state during a part of the flyback period T2 of each sub-frame.

In the valid video period T1 of the first sub-frame, only the red-color organic EL low-level power supply voltage ELVSS (R) is set to a relatively low level. In the valid video period T2 of the second sub-frame, only the green-color organic EL low-level power supply voltage ELVSS(G) is set to a relatively low level. In the valid video period T1 of the third sub-frame, only the blue-color organic EL low-level power supply voltage ELVSS(B) is set to a relatively low level. Thus, only the organic EL element OLED(R) becomes in the light-on state during the valid video period T1 of the first sub-frame, only the organic EL element OLED(G) becomes in the light-on state during the valid video period T1 of the second sub-frame, and only the organic EL element OLED(B) becomes in the light-on state during the valid video period T1 of the third sub-frame.

In the flyback period T2 of each sub-frame, all the red-color organic EL low-level power supply voltage ELVSS(R), the green-color organic EL low-level power supply voltage ELVSS(G), and the blue-color organic EL low-level power supply voltage ELVSS(B) are set to relatively high levels. Accordingly, in the flyback period T2 of each sub-frame, all the organic EL element OLED(R), the organic EL element OLED(G), and the organic EL element OLED(B) become in the light-out state. Here, during the flyback period T2 of each sub-frame, the source driver 200 applies an analog voltage corresponding to the black color, as a driving video signal, to all the data lines DL1 to DLm. Accordingly, the above black insertion is performed during the flyback period T2 of each sub-frame.

Figure 25:
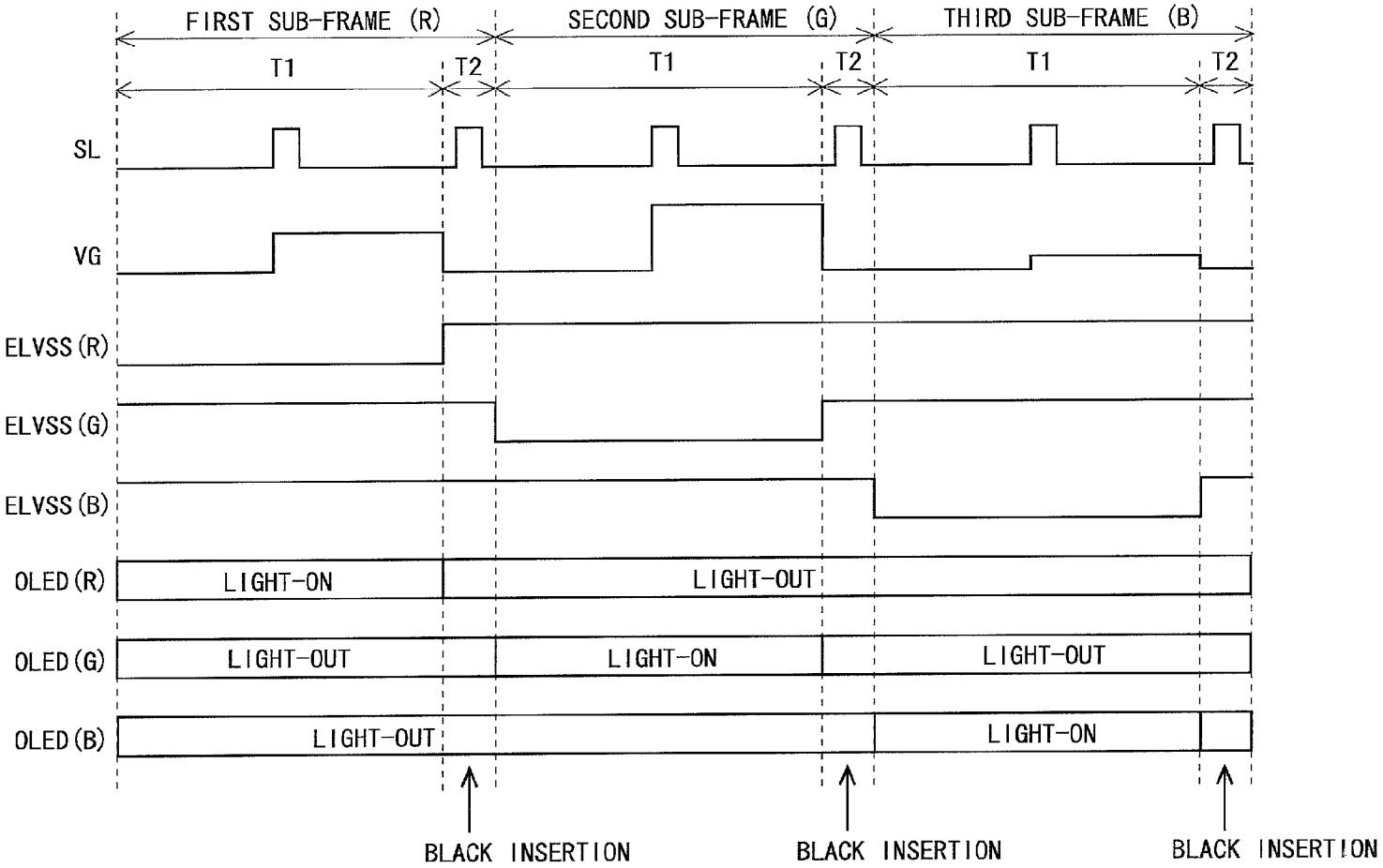
FIG. 25 is a timing chart for describing the operation of a pixel circuit corresponding to one pixel in the third embodiment.
Figure 26:
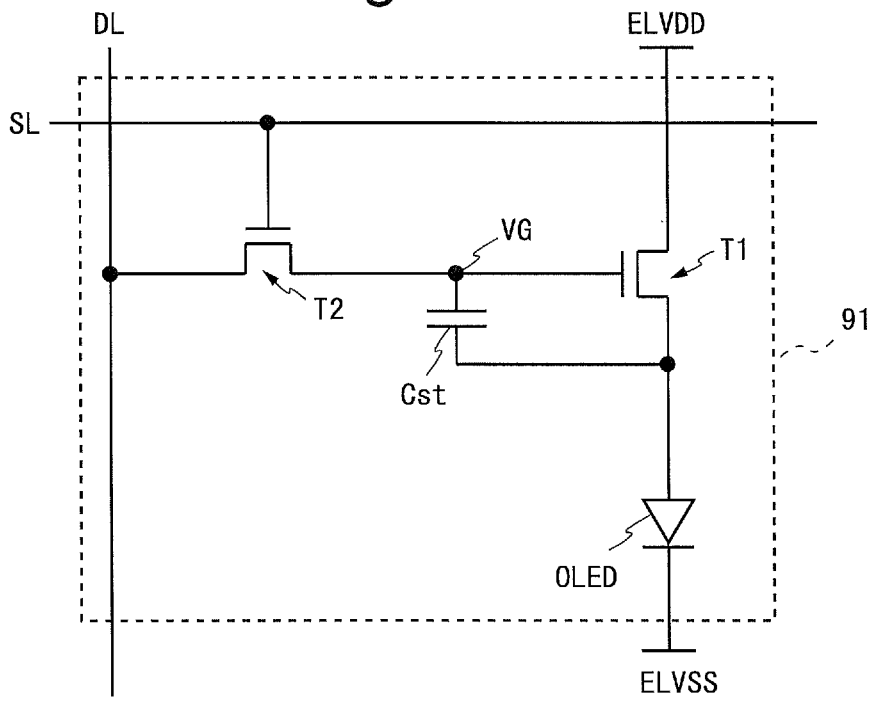
FIG. 26 is a circuit diagram illustrating a configuration of a conventional general pixel circuit configuring one sub-pixel.
Figure 27:
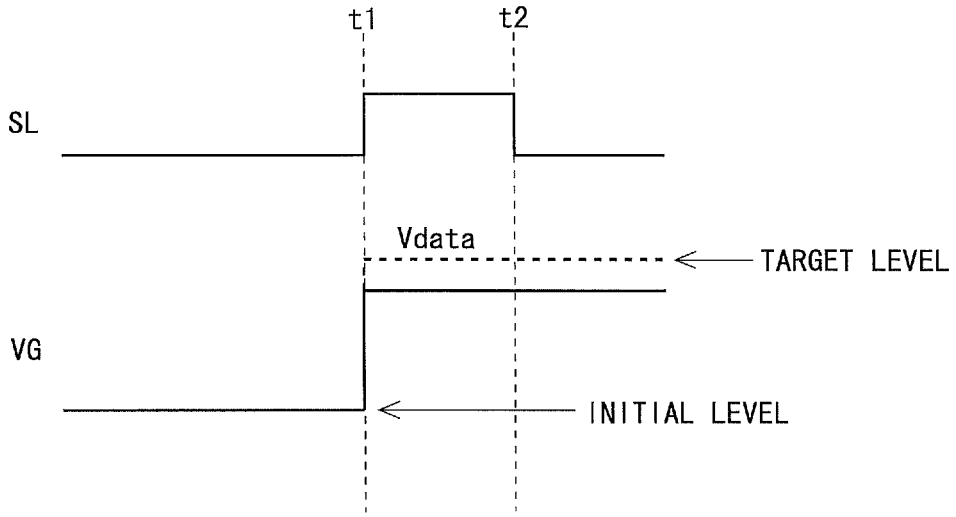
FIG. 27 is a timing chart for describing the operation of the pixel circuit illustrated in FIG. 26.
Figure 28:
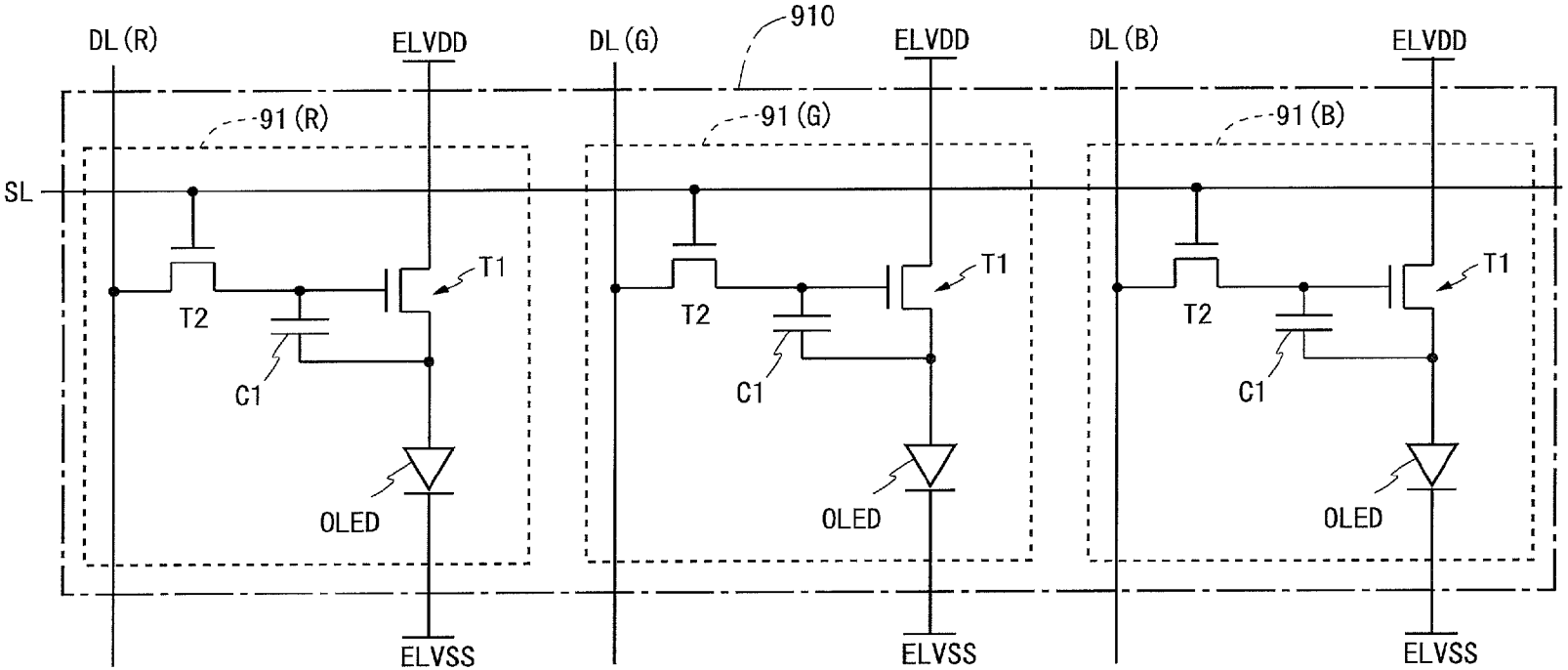
FIG. 28 is a circuit diagram illustrating a configuration of a pixel circuit corresponding to one pixel in a first conventional example.

Next, the operation of the pixel circuit 40 corresponding to one pixel will be described in detail with reference to FIG. 1 and FIG. 25. Here, attention will be focused on one pixel included in a k-th row. When the scanning signal line SL has changed from the unselected state to the selected state during the valid video period T1 of each sub-frame, the transistor T2 is turned on. Accordingly, a data voltage of magnitude corresponding to the luminance of the color of the sub-frame at the current time point is supplied to the gate node VG via the data line DL and the transistor T2. Then, during a period when the scanning signal line SL is in the selected state, the capacitor Cst is charged to the gate-source voltage Vgs which is a difference between the potential of the gate node VG and the source potential of the transistor T1. Thereafter, when the scanning signal line SL has changed from the selected state to the unselected state, the transistor T2 is turned off. As a result, the gate-source voltage Vgs held by the capacitor Cst is established. The transistor T1 supplies a driving current to the organic EL element OLED according to the gate-source voltage Vgs held by the capacitor Cst. In this case, a driving current is supplied to the organic EL element OLED(R) in the first sub-frame, a driving current is supplied to the organic EL element OLED(G) in the second sub-frame, and a driving current is supplied to the organic EL element OLED(B) in the third sub-frame. As a result, in each pixel, the organic EL element OLED emits light with desired luminance in each sub-frame.

Thereafter, in the flyback period T2 of each sub-frame, a value of the data voltage becomes a value corresponding to the black display. Then, when the scanning signal line SL has changed from the unselected state to the selected state during the flyback period T2 of each sub-frame, the transistor T2 is turned on. Thus, a data voltage of magnitude corresponding to the black display is supplied to the gate node VG via the data line DL and the transistor T2. Then, the above black insertion is performed during a period when the scanning signal line SL is in the selected state. Thereafter, when the scanning signal line SL has changed from the selected state to the unselected state, the transistor T2 is turned off. Because the black insertion is performed in the manner as described above, the black display is performed during a period until the scanning signal line SL changes from the unselected state to the selected state during the valid video period T1 of the next sub-frame in this pixel.

<3.3 Effects>

According to the present embodiment, the organic EL display device equipped with an organic EL element OLED which is a self light-emitting type display element can be realized by using a pixel circuit having a configuration simpler than the conventional configuration, in the same manner as the first embodiment. In the present embodiment, black insertion is performed during the flyback period T2 of each sub-frame. Therefore, light emission of the organic EL element OLED with the luminance corresponding to the writing in one preceding sub-frame is prevented in each sub-frame. As a result, more satisfactory display quality can be realized.

<4. Others>

The present invention is not limited to the above embodiments, and can be implemented by various modifications within the scope not deviating from the gist of the present invention. For example, although the organic EL display device has been described as an example in the above embodiments, the present invention can also be applied to a display device other than the organic EL display device, so long as the display device is equipped with a self light-emitting type display element which is driven by a current.

Further, although the n-channel transistor has been used as a transistor in the pixel circuits 40 and 41 in the above embodiments, the p-channel transistor may also be used.

DESCRIPTION OF REFERENCE CHARACTERS

1, 2, 3: ORGANIC EL DISPLAY DEVICE
7: ORGANIC EL PANEL
40, 41: PIXEL CIRCUIT
100: DISPLAY CONTROL CIRCUIT
110: LOW-LEVEL POWER SUPPLY CONTROL UNIT
200: SOURCE DRIVER
300, 301: GATE DRIVER
320: BLACK INSERTION CONTROL UNIT
400: DISPLAY UNIT
510: ORGANIC EL HIGH-LEVEL POWER SUPPLY
520(R): RED-COLOR ORGANIC EL LOW-LEVEL POWER SUPPLY
520(G): GREEN-COLOR ORGANIC EL LOW-LEVEL POWER SUPPLY
520(B): BLUE-COLOR ORGANIC EL LOW-LEVEL POWER SUPPLY
T1: DRIVING TRANSISTOR
T2: INPUT TRANSISTOR
Cst: CAPACITOR
OLED(R): RED-COLOR ORGANIC EL ELEMENT (ELECTRO-OPTICAL ELEMENT)
OLED(G): GREEN-COLOR ORGANIC EL ELEMENT (ELECTRO-OPTICAL ELEMENT)
OLED(B): BLUE-COLOR ORGANIC EL ELEMENT (ELECTRO-OPTICAL ELEMENT)
DL, DL1 to DLm: DATA LINE
SL, SL1 to SLn: SCANNING SIGNAL LINE
ELVDD: HIGH-LEVEL POWER SUPPLY VOLTAGE, HIGH-LEVEL POWER SUPPLY LINE
ELVSS(R): RED-COLOR ORGANIC EL LOW-LEVEL POWER SUPPLY VOLTAGE, RED-COLOR ORGANIC EL LOW-LEVEL POWER SUPPLY LINE
ELVSS(G): GREEN-COLOR ORGANIC EL LOW-LEVEL POWER SUPPLY VOLTAGE, GREEN-COLOR ORGANIC EL LOW-LEVEL POWER SUPPLY LINE
ELVSS(B): BLUE-COLOR ORGANIC EL LOW-LEVEL POWER SUPPLY VOLTAGE, BLUE-COLOR ORGANIC EL LOW-LEVEL POWER SUPPLY LINE

The invention claimed is:

1. An active matrix-type display device configured to display a color image by dividing one frame period into a plurality of sub-frames and displaying a screen image of a different color for each of the sub-frames, the active matrix-type display device comprising:

a plurality of data lines;

a plurality of scanning signal lines disposed to be orthogonal to the plurality of data lines;

a plurality of pixel circuits provided corresponding to intersections of the plurality of data lines and the plurality of scanning signal lines;

a first power supply line configured to supply a constant voltage to the plurality of pixel circuits;

a plurality of second power supply lines configured to supply a relatively high-level first voltage and a relatively low-level second voltage to the plurality of pixel circuits, the plurality of second power supply lines corresponding, in a one-to-one manner, to the plurality of sub-frames included in the one frame period;

a data line drive circuit configured to apply a video signal to the plurality of data lines;

a scanning signal line drive circuit configured to apply a scanning signal to the plurality of scanning signal lines; and a second power supply control unit configured to control a voltage to be given to the plurality of second power supply lines, wherein the pixel circuit comprises:

a plurality of self light-emitting type electro-optical elements provided between each of the plurality of second power supply lines and the first power supply line, the plurality of self light-emitting type electro-optical elements corresponding, in a one-to-one manner, to the plurality of sub-frames included in the one frame period;

one first transistor that is provided to be in series with the plurality of electro-optical elements between the first power supply line and the plurality of second power supply lines, and that controls a driving current to be supplied to the plurality of electro-optical elements;

a second transistor that is provided between a control terminal of the first transistor and one of the data lines, and that electrically connects the control terminal of the first transistor and the data line when a scanning signal applied to a corresponding scanning signal line has been set active by the scanning signal line drive circuit; and a capacitor provided between the control terminal of the first transistor and one conductive terminal of the first transistor, and when any sub-frame included in the one frame period is assumed as a focused sub-frame, the second power supply control unit controls a voltage to be given to the plurality of second power supply lines such that, in the focused sub-frame, a voltage applied to an electro-optical element corresponding to the focused sub-frame becomes equal to or higher than a light emission threshold value and also a voltage applied to an electro-optical element other than the electro-optical element corresponding to the focused sub-frame becomes less than the light emission threshold value.

2. The display device according to claim 1, wherein the data line drive circuit applies a voltage corresponding to a black color as the video signal to the plurality of data lines during a flyback period of each of the sub-frames, and the scanning signal line drive circuit applies active scanning signals simultaneously to the plurality of scanning signal lines during a flyback period of each of the sub-frames.

3. The display device according to claim 1, wherein a sub-frame appears 180 times or more during one second.

4. The display device according to claim 1, wherein a constant voltage given to the first power supply line is set to a higher level than that of the first voltage, and the second power supply control unit controls a voltage to be given to the plurality of second power supply lines such that, in the focused sub-frame, the second voltage is given to a second power supply line corresponding to the focused sub-frame and also the first voltage is given to a second power supply line other than the second power supply line corresponding to the focused sub-frame.

5. The display device according to claim 1, wherein the first transistor and the second transistor are thin-film transistors having a channel layer formed of an oxide semiconductor.

6. The display device according to claim 5, wherein the oxide semiconductor is Indium Gallium Zinc Oxide including indium (In), gallium (Ga), zinc (Zn), and oxygen (O) as main components.

7. A method for driving an active matrix-type display device configured to display a color image by dividing one frame period into a plurality of sub-frames and displaying a screen image of a different color for each of the sub-frames, the active matrix-type display device comprising a plurality of data lines; a plurality of scanning signal lines disposed to be orthogonal to the plurality of data lines; a plurality of pixel circuits provided corresponding to intersections of the plurality of data lines and the plurality of scanning signal lines; a first power supply line configured to supply a constant voltage to the plurality of pixel circuits; and a plurality of second power supply lines configured to supply a relatively high-level first voltage and a relatively low-level second voltage to the plurality of pixel circuits, the plurality of second power supply lines corresponding, in a one-to-one manner, to the plurality of sub-frames included in the one frame period; the method comprising:

a data line driving step for applying a video signal to the plurality of data lines;

a scanning signal line driving step for applying a scanning signal to the plurality of scanning signal lines; and a second power supply control step for controlling a voltage to be given to the plurality of second power supply lines, wherein the pixel circuit comprises:

a plurality of self light-emitting type electro-optical elements provided between each of the plurality of second power supply lines and the first power supply line, the plurality of self light-emitting type electro-optical elements corresponding, in a one-to-one manner, to the plurality of sub-frames included in the one frame period, one first transistor that is provided to be in series with the plurality of electro-optical elements between the first power supply line and the plurality of second power supply lines, and that controls a driving current to be supplied to the plurality of electro-optical elements, a second transistor that is provided between a control terminal of the first transistor and one of the data lines, and that electrically connects the control terminal of the first transistor and the data line when a scanning signal applied to a corresponding scanning signal line has been set active in the scanning signal line driving step, and a capacitor provided between the control terminal of the first transistor and one conductive terminal of the first transistor, and when any sub-frame included in the one frame period is assumed as a focused sub-frame, in the second power supply control step, a voltage to be given to the plurality of second power supply lines is controlled such that, in the focused sub-frame, a voltage applied to an electro-optical element corresponding to the focused sub-frame becomes equal to or higher than a light emission threshold value and also a voltage applied to an electro-optical element other than the electro-optical element corresponding to the focused sub-frame becomes less than the light emission threshold value.

* * * * *